US009205652B2

(12) United States Patent
Sameshima et al.

(10) Patent No.: US 9,205,652 B2
(45) Date of Patent: *Dec. 8, 2015

(54) LIQUID EJECTION HEAD, AND IMAGE FORMING APPARATUS USING THE LIQUID EJECTION HEAD

(71) Applicant: RICOH COMPANY, LTD., Tokyo (JP)

(72) Inventors: Tatsuya Sameshima, Kanagawa (JP); Shinichi Kakuda, Kanagawa (JP); Hisashi Habashi, Kanagawa (JP); Takashi Mori, Kanagawa (JP); Kaname Morita, Tokyo (JP); Daisuke Takagi, Kanagawa (JP); Hitoshi Usami, Kanagawa (JP); Tomoyuki Aratani, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/291,478

(22) Filed: May 30, 2014

(65) Prior Publication Data

US 2014/0375725 A1 Dec. 25, 2014

(30) Foreign Application Priority Data

Jun. 23, 2013 (JP) ..... 2013-131213

(51) Int. Cl.

| | |
|---|---|
| ***B41J 2/135*** | (2006.01) |
| ***B41J 2/14*** | (2006.01) |
| ***B41J 2/16*** | (2006.01) |

(52) U.S. Cl.

CPC ..... *B41J 2/1433* (2013.01); *B41J 2/14233* (2013.01); *B41J 2/1606* (2013.01)

(58) Field of Classification Search

USPC ..... 347/44–45

See application file for complete search history.

(56) References Cited

U.S. PATENT DOCUMENTS

| | | | | |
|---|---|---|---|---|
| 6,109,728 | A | 8/2000 | Kakuda et al. | |
| 2007/0058006 | A1 | 3/2007 | Kakuda | |
| 2007/0115323 | A1 | 5/2007 | Mori | |
| 2007/0242107 | A1 | 10/2007 | Mori | |
| 2007/0247492 | A1 | 10/2007 | Mori | |
| 2008/0111854 | A1 | 5/2008 | Laffay et al. | |
| 2008/0174631 | A1 | 7/2008 | Habashi | |
| 2009/0033704 | A1 | 2/2009 | Mori | |
| 2009/0058921 | A1 | 3/2009 | Habashi | |
| 2010/0295891 | A1 | 11/2010 | Goto et al. | |
| 2011/0094102 | A1* | 4/2011 | Guan et al. | 29/890.1 |
| 2012/0069093 | A1 | 3/2012 | Kuwata et al. | |
| 2012/0274707 | A1* | 11/2012 | Cai et al. | 347/47 |

FOREIGN PATENT DOCUMENTS

| | | |
|---|---|---|
| JP | 2000-263796 | 9/2000 |
| JP | 2004-351923 | 12/2004 |
| JP | 2007-168393 | 7/2007 |

(Continued)

OTHER PUBLICATIONS

U.S. Appl. No. 14/203,778, filed Mar. 11, 2014.

*Primary Examiner* — Jason Uhlenhake

(74) *Attorney, Agent, or Firm* — Cooper & Dunham LLP

(57) ABSTRACT

A liquid ejection head is provided. The liquid ejection head includes a nozzle substrate to eject a droplet of a liquid from a nozzle thereof; a surface treatment layer, which is located on the surface of the nozzle substrate and which is an oxide layer including silicon (Si) and a transition metal capable of forming a passive layer; and an organic liquid repellent layer located on the surface treatment layer.

10 Claims, 7 Drawing Sheets

(56) References Cited

FOREIGN PATENT DOCUMENTS

| | | | |
|---|---|---|---|
| JP | 2007-253484 | | 10/2007 |
| JP | 2007-253485 | | 10/2007 |
| JP | 2009-113351 | | 5/2009 |
| JP | 2009-214338 | | 9/2009 |
| JP | 2009-220412 | | 10/2009 |
| JP | 2009220412 | A * | 10/2009 |

* cited by examiner

LIQUID EJECTION HEAD, AND IMAGE FORMING APPARATUS USING THE LIQUID EJECTION HEAD

CROSS-REFERENCE TO RELATED APPLICATIONS

This patent application is based on and claims priority pursuant to 35 U.S.C. §119 to Japanese Patent Application No. 2013-131213 filed on Jun. 23, 2013 in the Japan Patent Office, the entire disclosure of which is hereby incorporated by reference herein.

TECHNICAL FIELD

This disclosure relates to a liquid ejection head. In addition, this disclosure relates to an image forming apparatus using the liquid ejection head.

BACKGROUND

Image forming apparatuses using a liquid ejection head (i.e., droplet ejection head) such as ink droplet ejection heads have been used for printers, copiers, plotters and multifunctional products having two or more of the printing, facsimileing, copying and plotting functions. Specific examples of such image forming apparatuses include inkjet recording apparatuses.

With respect to the liquid ejection head, liquid ejection heads using a piezoelectric actuator, a thermal actuator or an electrostatic actuator as a pressure generating device (i.e., actuator) are known.

The liquid ejection property of a liquid ejection head is largely affected by the condition of the droplet ejection surface (i.e., nozzle forming surface) of the nozzle substrate of the liquid ejection head. For example, when a liquid adheres to the peripheral part of a nozzle of a liquid ejection head, the droplet ejection direction of the liquid ejection head varies. In addition, if the liquid is solidified, the diameter of the nozzle narrows, and thereby a problem such that the amount (size) of a droplet ejected from the liquid ejection head is decreased or the droplet ejection speed is varied is caused. In attempting to prevent occurrence of such a problem, i.e., to enhance the droplet ejection property of a liquid ejection head, a liquid repellent layer (such as water repellent layer and ink repellent layer) is typically formed on the surface of the droplet ejection surface of the liquid ejection head.

JP-2009-214338-A discloses a droplet ejection head having a structure such that a surface treatment layer (intermediate layer) such as a $SiO_2$ layer is formed on an ejection surface of the nozzle substrate of the droplet ejection head as a base layer, and an organic liquid repellent layer such as a resin layer is formed on the base layer.

In addition, JP-2004-351923-A discloses a liquid ejection head having a structure such that a plasma polymerization layer of a silicone material is formed on an ejection surface of a nozzle substrate of the liquid ejection head as a base layer, and a liquid repellent layer such as a molecular layer of a polymerized metal alkoxide is formed on the base layer. In this head, materials including one of $SiO_2$, ZnO, NiO, $SnO_2$, $Al_2O_3$ $ZrO_2$, copper oxide, silver oxide, chromium oxide, and iron oxide can be used for the base layer other than the plasma polymerization layer of a silicone material.

SUMMARY

As an aspect of this disclosure, a liquid ejection head is provided which includes a nozzle substrate to eject a droplet of a liquid from a nozzle thereof; a surface treatment layer, which is located on the surface of the nozzle surface and which is an oxide layer including Si; and an organic liquid repellent layer located on the surface treatment layer. The oxide layer further includes a transition metal capable of forming a passive layer.

As another aspect of this disclosure, an image forming apparatus is provided which includes the above-mentioned liquid ejection head to eject a droplet of a liquid from a nozzle thereof to form an image on an object, and a support to support the liquid ejection head.

The aforementioned and other aspects, features and advantages will become apparent upon consideration of the following description of the preferred embodiments taken in conjunction with the accompanying drawings.

DETAILED DESCRIPTION

Since an organic liquid repellent layer is a thin layer of an organic material, water permeates the layer, and therefore the organic liquid repellent layer is easily peeled from the base layer (i.e., surface treatment layer) if the base layer has poor resistance to the liquid used for the liquid ejection head (such as ink).

Therefore, as described in JP-2009-214338-A, a surface treatment layer constituted of a water-impermeable material such as $SiO_2$, SiON, SiN, SiC, SiCN, $TiO_2$ and TiN is typically used as the base layer.

However, a surface treatment layer constituted of such a material as mentioned above is changed to a hydroxide when the layer is contacted with a strongly-alkaline liquid. In this case, the surface treatment layer is easily ionized, and thereby the layer is dissolved in the liquid. When the surface treatment layer is dissolved in the liquid used, the liquid repellent layer on the surface treatment layer is peeled from the liquid ejection head.

Even when the base layer is constituted of two or more of the materials (such as oxides) described in JP-2004-351923-A, one or more of the materials, which are included in the base layer and which have poor resistance to the liquid used, are dissolved in the liquid, and thereby the base layer is dissolved, resulting in peeling of the liquid repellent layer.

The object of this disclosure is to enhance the resistance to liquids (such as ink) of a base layer located between an organic liquid repellent layer and a nozzle substrate.

Figure 1:
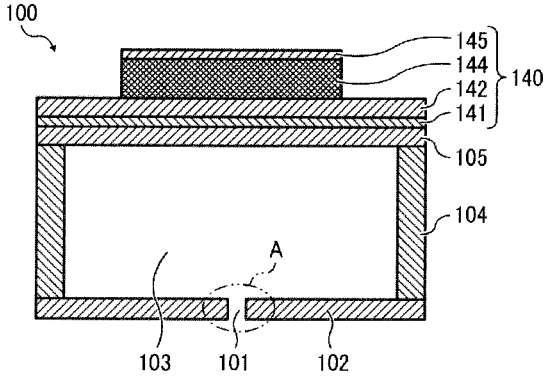
FIG. 1 is a cross-sectional view illustrating an example of the liquid ejection head according to an embodiment.

Initially, a first embodiment of the liquid ejection head of this disclosure will be described by reference to FIG. 1. FIG. 1 is a cross-sectional view of the liquid ejection head.

Referring to FIG. 1, a liquid ejection head 100 includes a nozzle plate 102 which serves as a nozzle member and on which a nozzle 101 to eject a droplet is formed, a flow passage plate 104 which forms a flow passage (hereinafter referred to as a pressure chamber) 103 connected with the nozzle 101, and a vibration plate 105 serving as a wall of the pressure chamber 103, wherein the nozzle plate 102, the flow passage plate 104, and the vibration plate 105 are overlaid while adhered to each other by an adhesive to form the flow passage (i.e., to serve as a flow passage forming member).

In addition, a piezoelectric actuator including an electromechanical converter 140 is formed on a side of the vibration plate 105 opposite to the side thereof facing the pressure chamber 103.

The electromechanical converter 140 includes an oxide electrode 141 serving as an adhesive layer, a first electrode (lower electrode) 142, an electromechanical conversion layer 144, and a second electrode (upper electrode) 145, which are overlaid in this order on the vibration plate 105.

Each of the first and second electrodes 142 and 145 is formed of a material having a high electroconductivity such as Pt and Au. The electromechanical conversion layer 144 is formed of a PZT (piezoelectric zirconate titanate), and the flow passage plate 104 is formed of silicon.

The nozzle plate 102 and the flow passage plate 104 are adhered to each other by an adhesive.

Figure 2:
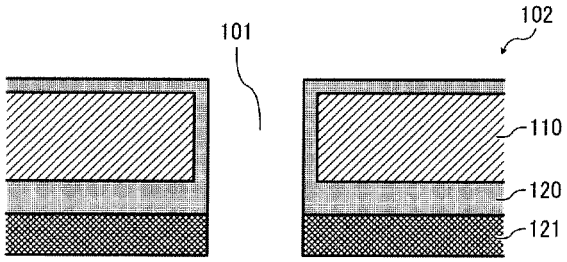
FIG. 2 is an enlarged view of a portion A of the liquid ejection head illustrated in FIG. 1.

Next, the nozzle plate 102 of the liquid ejection head 100 will be described in detail by reference to FIG. 2. FIG. 2 is an enlarged view of a portion A of the liquid ejection head illustrated in FIG. 1.

The nozzle plate 102 includes a nozzle substrate 110 on which the nozzle 101 is formed, a surface treatment layer 120 which is formed on the surface of the nozzle substrate 110, and an organic liquid repellent layer 121 which is formed on a surface of the surface treatment layer 120.

The surface treatment layer 120 includes a transition metal which can form a passive layer with Si via oxygen.

In this regard, the surface treatment layer 120 is a complex oxide layer of a transition metal and Si, wherein the transition metal forms a passive layer having good resistance to ink and good adhesiveness to the organic liquid repellent layer 121.

The organic liquid repellent layer 121 of the nozzle plate 102 is a thin layer of an organic material, and therefore water permeates the organic liquid repellent layer. Therefore, if the surface treatment layer 120 does not have good resistance to ink, the ink, which permeates the organic liquid repellent layer 121, corrodes the surface treatment layer 120, resulting in peeling of the organic liquid repellent layer 121 from the nozzle plate 102, thereby causing a problem in that part of the nozzle plate 102 does not have the organic liquid repellent layer 121.

Figure 3:
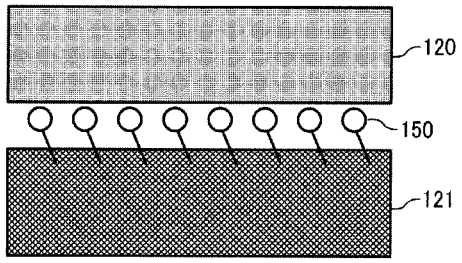
FIG. 3 is a schematic view for describing the reactive group of an organic liquid repellent layer.

In the liquid ejection head of this example, a reactive group 150 (illustrated in FIG. 3) of the organic liquid repellent layer 121, such as a methoxy group (Si—$OCH_3$) and an ethoxy group (Si—$OC_2H_5$), is hydrolyzed to form a silanol group (Si—OH). This hydrolysis can be performed before or while film formation of the organic liquid repellent layer 121 is performed.

The above-mentioned silanol group of the organic liquid repellent layer 121 is bonded to a hydroxyl group present on the surface of the surface treatment layer 120 by a hydrogen bond.

When the organic liquid repellent layer 121 and the surface treatment layer 120 thus bonded to each other are allowed to settle at room temperature or heated, the hydrogen-bonded portion is subjected to a dehydration condensation reaction, and thereby the hydrogen-bonded portion is changed to a siloxane bond (Si—O—Si).

Since the siloxane bond is a covalent bond and has a high bond energy, the adhesiveness of the surface treatment layer 120 to the organic liquid repellent layer 121 can be enhanced.

Therefore, in order to enhance the adhesiveness of the surface treatment layer 120 to the organic liquid repellent layer 121, it is necessary that a hydroxyl group is formed on the surface of the surface treatment layer 120. In this regard, when $SiO_2$, which has a silanol group (Si—OH) on the surface thereof, is included in the surface treatment layer 120, the number of hydroxyl groups present on the surface of the surface treatment layer 120 can be increased.

In addition, the above-mentioned transition metal can form a stable oxide, which is stable in water, and therefore the nozzle plate 102 has good resistance to ink.

As mentioned above, the surface treatment layer 120 is formed on the surface of the nozzle substrate 110 of the nozzle plate 102, and the surface treatment layer is a Si-containing oxide layer including a transition metal capable of forming a passive layer. Therefore, the adhesiveness of the surface treatment layer 120 to the organic liquid repellent layer 121 at the interface therebetween can be enhanced while enhancing the reliability in resistance of the nozzle plate 102 to ink.

Specifically, since the surface treatment layer 120 includes $SiO_2$, the adhesiveness of the surface treatment layer 120 to the nozzle substrate 110 and the organic liquid repellent layer 121 can be enhanced. In addition, since such a passive layer as mentioned above is formed, the surface treatment layer 120 has an anticorrosion layer on the surface thereof, the surface treatment layer can maintain good stability for a long period of time even when being contacted with a liquid.

Transition metals have a vacant orbit at an inner orbit of the d-orbit to the f-orbit, and therefore transition metals can have plural oxidation numbers. Therefore, when the surface treatment layer 120 includes a transition metal, the flexibility in variation of the oxidation numbers of the layer can be enhanced, thereby enhancing the allowance of excess and deficiency of oxygen atoms in the layer. Accordingly, the surface treatment layer 120 can have good stability even when the number of oxygen atoms in the layer is excess or deficient.

When the surface treatment layer 120 includes no transition metal, the surface treatment layer has defects due to excess or deficiency of oxygen atoms in the layer, and thereby the layer is easily dissolved in liquids because such defects achieves a high energy state.

In contrast, when the surface treatment layer 120 includes a transition metal, the number of defects in the surface treatment layer can be reduced, and thereby the solubility of the surface treatment layer can be decreased.

Among various transition metals, valve metals, which can form a passive layer, are preferable because the solubility of the surface treatment layer in liquids can be further decreased.

Specific examples of metals capable of forming a passive layer include tantalum, niobium, titanium, hafnium, zirconium and tungsten, which have good flexibility in variation of the oxidation numbers.

In addition, each of hafnium, tantalum, zirconium and niobium can form an oxide layer which is very stable even when being contacted with acidic or alkaline liquids. Namely, the metals have an advantage such that the resultant surface treatment layer has good resistance to acidic or alkaline liquids.

In other words, the surface treatment layer 120 preferably includes a Group-4 or Group-5 transition metal which can form a passive layer. Since a Group-4 or Group-5 transition metal has an electron orbital similar to that of Si which is a Group-4 element, the transition metal can be strongly connected with Si via oxygen when the transition metal is included in a $SiO_2$ layer, and thereby a dense surface treatment layer can be formed because the layer has good packing property.

In addition, by including such a transition metal in the surface treatment layer 120 which has a strong Si—O bond, not only good packing property but also good corrosion resistance can be imparted to the layer. Specifically, even when the surface treatment layer 120 is contacted with various liquids, the layer hardly causes a corrosion reaction.

Thus, an oxide layer having good resistance to various liquids can be formed, and therefore the surface treatment layer 120 has good resistance to liquids, resulting in enhancement of the reliability of the liquid ejection head.

The surface treatment layer 120 of the liquid ejection head of this disclosure preferably includes at least one of Hf, Ta and Zr as a Group-4 or Group-5 element which can form a passive layer.

By including at least one of Hf, Ta and Zr in the $SiO_2$ layer (surface treatment layer), the transition metal can be strongly bonded with oxygen, and forms a passive layer. In this case, the packing property of the surface treatment layer 120 can be enhanced, and in addition the layer can have a function of the passive layer, thereby preventing the layer from causing a corrosion reaction even when the layer is contacted with acidic or alkaline liquids. Namely, an oxide layer having good resistance to acidic and alkaline liquids can be formed.

It is preferable that the surface treatment layer 120 is perfectly oxidized. In this case, the surface treatment layer 120 has an amorphous state, and hardly includes grain boundaries which easily cause corrosion when the layer is contacted with liquids. Therefore, the surface treatment layer 120 has good resistance to liquids.

The surface treatment layer 120 preferably includes Si in an amount of not less than 17 atomic %, and more preferably not less than 20 atomic %, so that the layer is a perfectly transparent layer.

In this case, the surface treatment layer 120 achieves an amorphous state, and the transition metal is evenly present in the layer. Namely, the surface treatment layer 120 is prevented from including a crystal portion, and therefore the number of portions having poor resistance to liquids in the layer can be reduced. When the content of Si in the surface treatment layer 120 is too low, metals other than Si cause aggregation and crystallization, and therefore the layer becomes unbalanced in film property. In this case, a battery effect is produced between Si and other metals, and thereby a corrosion reaction is often caused.

In this regard, whether or not the metal alloy layer forming the surface treatment layer 120 is perfectly oxidized can be determined by checking whether the layer, which is in an amorphous state, can transmit visible light. Specifically, the attenuation coefficient (k) of the layer is measured with an ellipsometer, and when the attenuation coefficient (k) in a wavelength range of from 400 nm to 800 nm is not greater than 0.1, and preferably not greater than 0.03, the layer is considered to be perfectly oxidized.

In addition, the surface treatment layer 120 preferably includes a transition metal in an amount of not less than 2 atomic %, and more preferably from 3.5 to 13.5 atomic %, so that the density of the layer can be increased, and the resistance of the layer to liquids can be enhanced. In this case, the surface treatment layer 120 hardly includes defects while having a structure with a high filling rate, thereby enhancing the resistance of the layer to liquids (such as ink).

In this regard, whether or not the layer has such a film property can be determined by checking whether the layer has a constant refraction index using an ellipsometer. For example, a $SiO_2$ film has a refraction index of 1.4, and a $Ta_2O_5$ film has a refraction index of 2.1. Therefore, when the surface treatment layer 120 is perfectly oxidized, the layer has a refraction index of from 1.4 to 2.1. However, if the metals in the surface treatment layer 120 are not perfectly oxidized, the permeability of the layer decreases and the refraction index thereof increases. Therefore, it is preferable that both the refraction index and the permeability of the surface treatment layer 120 are controlled so that the layer has the desired film property.

When films of metal oxides constituting the surface treatment layer 120 have difference refraction indexes, it is possible to control the ratio of the metals by checking the refraction index of the layer. By using this method, the ratio of metals in the surface treatment layer 120 can be determined at a high speed in the atmosphere without destroying the layer. Therefore, this method can be used for the production process of the surface treatment layer 120, and control of production conditions can be easily performed.

Thin film forming methods such as vapor deposition methods, sputtering methods, CVD (chemical vapor deposition) methods, and ALD (atomic layer deposition) methods can be used for forming the surface treatment layer 120. Particularly, when the nozzle substrate 110 is made of a material which is easily deformed when a heat treatment is performed, it is preferable to form the surface treatment layer 120 using a sputtering method, or an ALD method which is performed at a temperature not higher than 160° C., and preferably not higher than 120° C.

Particularly, the ALD methods have an advantage such that the film forming reaction is completed for every single atomic layer, and therefore a dense layer with fewer defects can be formed than in a case using a CVD method or a vapor deposition method. In addition, in the ALD methods, a film can be formed on a portion on which a gas can be adsorbed, and therefore the surface treatment layer can be evenly formed on a portion of the nozzle substrate such as side walls of nozzles (such as the side walls of the nozzle 101 illustrated in FIGS. 1 and 2).

The sputtering methods (i.e., physical vapor deposition (PVD) methods) beat a metal ion out of the target using an Ar ion, and therefore a film hardly including impurity can be formed. In addition, since a film is formed by beating an ion out of the target in vacuum, the resultant layer has good adhesiveness to the nozzle substrate. Further, since the reaction is performed without using heat, the nozzle substrate 110 can be cooled, and therefore the layer can be formed at a temperature near room temperature. Therefore, even when a material having poor heat resistance is used for the nozzle substrate 110, a surface treatment layer having good resistance to liquids can be formed thereon.

As illustrated in FIG. 2, the surface of the nozzle 101 of the nozzle substrate 110 and the surface of the nozzle substrate forming the pressure chamber 103 are preferably coated with the surface treatment layer 120.

In this regard, the thickness of the surface treatment layer 120 is at least 10 nm, and preferably not less than 25 nm. When the surface treatment layer 120 is too thin, it becomes difficult to cover a defected portion of the nozzle substrate 110 if the nozzle substrate has such a defected portion.

When the surface treatment layer 120 is formed inside the nozzle 101, it is not preferable that the surface treatment layer is thickened to an extent that the inner diameter of the nozzle 101 is largely different from the desired diameter. Therefore, the thickness of the surface treatment layer 120 is preferably not greater than 200 nm, and more preferably not greater than 50 nm.

When the surface treatment layer 120 is formed on the nozzle substrate 110, the layer is preferably formed by an ALD method at a temperature of not higher than 160° C., and preferably not higher than 120° C.

Figure 4A:
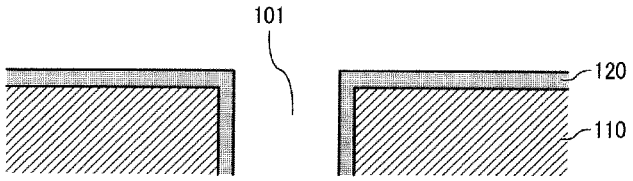
FIGS. 4A and 4B are schematic views for describing formation of a layer on a surface having projections and depressions using an atomic layer deposition (ALD) method.
Figure 4B:
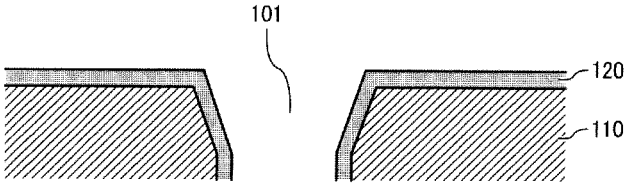

ALD methods have advantages such that control on the single molecular layer level can be performed; and an even layer can be formed on a member having such a vertical wall or a slanting wall as illustrated in FIGS. 4A and 4B because the layer is formed by using a surface reaction in the ALD methods.

In the ALD methods, the reactivity changes depending on the source gas used for the methods. When the temperature is not higher than 160° C., groups such as —$C_2H_5$, —Cl, and —$(N(CH_3)_2)$ are preferably used as the coordinating group of the metal. When the reaction is performed at a relatively low temperature, amino gases such as —$(N(CH_3)_2)$ are preferably used as the source gas.

In addition, $O_2$ plasma and $H_2O$, are generally used as the gas used for the reaction. Although $O_2$ plasma has high reactivity, $O_3$ formed in the plasma decomposes the source gas, and therefore a by-product tends to be produced. When the treatment is performed at a temperature of not higher than 160° C., such a by-product tends to be adhered to the chamber of the production apparatus or the substrate, thereby forming particles thereon, resulting in deterioration of the yield of the product.

In contrast, in a case of using $H_2O$, the reaction is only hydrolysis, and therefore production of such a by-product can be prevented. In addition, in the reaction, hydroxyl groups (—OH) are formed on the surface of the surface treatment layer. Therefore, when a source gas is fed in the following film forming process, adhesion of the source gas to the substrate can be accelerated. Therefore, $H_2O$ is preferably used for low-temperature film formation. When penta(dimethylamido) tantalum (PDMA-Ta) is used as the source gas, an even layer can be formed even at 80° C. However, when $H_2O$ is used, the film forming speed is slow, and therefore it is preferable to use a batch processing in which plural parts are treated at the same time.

When a layer (film) is formed by an ALD method, control on the atomic layer level can be performed. Therefore, it is possible to form an even single atomic layer if film formation is performed under proper conditions.

Figure 5:
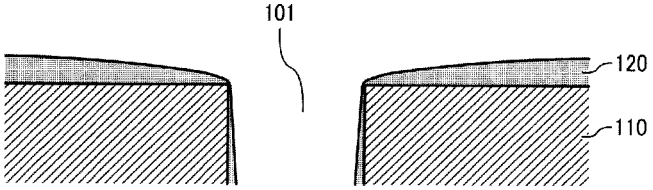
FIG. 5 is a schematic view for describing formation of a layer on a surface having projections and depressions using a sputtering method.

When the surface treatment layer 120 is formed by a sputtering method, an uneven layer such that portions of the layer located on art edge portion and a vertical wall are thin as illustrated in FIG. 5 is formed.

However, since it is not preferable to form a thick surface treatment layer on the inner wall of the nozzle 101 (i.e., the vertical walls illustrated in FIG. 5), the sputtering method is preferable in this regard. Specifically, even when the surface treatment layer 120 is formed by a sputtering method under a condition such that the portion of the resultant layer, which faces the pressure chamber 103 and which is continuously contacted with an ink, has the desired thickness, occurrence of the problem in that the diameter of the nozzle 101 decreases can be prevented.

When a sputtering method is used, a reactive sputtering method including projecting an Ar ion on the metal target while feeding an oxygen gas to oxidize the metal is typically used. Therefore, the resultant surface treatment layer 120 hardly includes impurities. Namely, the reactive sputtering method has an advantage such that an oxide layer hardly including impurities can be formed.

Next, the methods for producing the organic liquid repellent layer 121 and the surface treatment layer 120 and the methods for evaluating the layers will be described.

(Method for Producing the Organic Liquid Repellent Layer)

When components included in ink such as hydrophilic organic solvents and water penetrate into the interface between the organic liquid repellent layer 121 and the surface treatment layer 120, the above-mentioned problem in that the organic liquid repellent layer is peeled, or the adhesiveness of the organic liquid repellent layer to the surface treatment layer deteriorates is caused. Therefore, it is preferable to prevent ink from penetrating into the interface between the organic liquid repellent layer 121 and the surface treatment layer 120.

In order to prevent ink from penetrating into the interface, it is preferable to enhance the liquid repellency of the organic liquid repellent layer 121 so that adhesion of ink to the layer and penetration of ink into the layer are prevented.

In this embodiment, the organic liquid repellent layer 121 is formed on the surface of the surface treatment layer 120 (i.e., on the surface of the nozzle plate 102) using a vapor deposition device. In this regard, the method of forming the organic liquid repellent layer 121 is not limited to such a vapor deposition method, which is one of gaseous phase film forming methods, and other gaseous phase film forming methods such as sputtering (PVD) and CVD, and liquid phase film forming methods such as dipping methods, spin coating methods, and methods using a dispenser can also be used.

Silicone materials and fluorine-containing materials are well known as organic liquid repellent materials, and fluorine-containing materials are used for this embodiment. The fluorine-containing materials for use in this embodiment are organic polymers or copolymers of monomers, wherein the polymers and copolymers include one or more fluorine atom in average in one unit thereof, and have film forming ability.

Specific examples of such organic polymers or copolymers include polytetrafluoroethylene (PTFE), tetrafluoroethylene-perfluoroalkyl vinyl ether copolymers (PFA), tetrafluoroethylene-hexafluoropropylene-perfluoroalkyl vinyl ether copolymers, tetrafluoroethylene-hexafluoropropylene copolymers, tetrafluoroethylene-ethylene copolymers, polytrifluorochloroethylene, trifluorochloroethylene-ethylene copolymers, polyvinylfluoride, polyvinylidenefluoride, polymers of fluoropolyether, polyfluorosilicone, and perfluoropolymers having an aliphatic ring structure.

Among these fluorine-containing organic materials, perfluoro polymers are preferable, and perfluoro polymers, which have at least one of a double or triple bond carbon, a carboxyl group, a hydroxyl group, and a —$Si(OR)_3$ group (R is preferably an alkyl group having 1 to 3 carbon atoms) in the molecule, are more preferable.

By using a perfluoro polymer for the organic liquid repellent layer 121, the adhesiveness of the organic liquid repellent layer to the surface treatment layer 120 can be enhanced.

Specific examples of marketed products of preferable fluorine-containing organic materials include TSL8257 (from GE Toshiba Silicone (Momentive Performance Materials Inc.)), which is a fluoroalkyl silane having a —$Si(OR)_3$ group at the end of the main chain, and CYTOPs (from ASAHI GLASS CO., LTD.), which are amorphous perfluoro polymers having an aliphatic ring structure in the main chain thereof.

Next, the method for preparing the organic liquid repellent layer 121 on a substrate, in which the surface treatment layer 120 is formed on the nozzle substrate 110, using a vapor deposition method will be described.

(1) Initially, the substrate is subjected to a degreasing treatment. Cleaning using an organic solvent such as acetone, brush cleaning using isopropyl alcohol (WA), ultrasonic cleaning, and the like methods can be used as the degreasing treatment, and a proper method is selected therefrom depending on the property of the substrate.

(2) Next, a target and the substrate are set in the vapor deposition apparatus. Specifically, a fluorine-containing organic material is contained in an alumina-coated basket-type evaporation boat, and the substrate is set in the apparatus in such a manner that the nozzle surface of the nozzle plate 102 faces upward.

(3) Next, the vapor deposition apparatus is subjected to an exhaust treatment so that the inner pressure of the apparatus becomes $10^{-2}$ to $10^{-4}$ Pa. The inner pressure is preferably not higher than $5\times10^{-3}$ Pa.

(4) A current of 5 A is applied to the evaporation boat so that the boat is heated to 50° C. to remove the solvent used for cleaning, and then the current is changed to 10 A to heat the boat to 400° C. while maintaining the temperature for 3 minutes.

The thickness of the organic liquid repellent layer 121 is generally from 50 nm to 2,000 nm, and preferably from 100 nm to 200 nm.

In this example, the organic liquid repellent layer 121 is formed by vacuum deposition.

In this example, a perfluoropolyether (OPTOOL DSX from DAIKIN INDUSTRIES, Ltd.) is used as the fluorine-containing material, and the vacuum deposition is used as the preparation method of the organic liquid repellent layer 121, wherein the thickness of the layer is controlled so as to be from 5 nm to 20 nm. The resultant organic liquid repellent layer 121 has good liquid repellency.

After the vacuum deposition of the organic liquid repellent material is completed, the substrate is taken from the chamber of the vapor deposition apparatus. In this case, the fluorine-containing material and the surface treatment layer 120 are hydrolyzed by moisture in the air, and thereby the fluorine-containing material and the surface treatment layer 120 are reacted, resulting in formation of the organic liquid repellent layer 121.

(Surface Treatment Layer)

In the surface treatment which is performed on the nozzle substrate 110 before formation of the organic liquid repellent layer 121, an oxide layer including silicon is effective for a substrate, which includes a hydroxyl group or a silanol group such as $SiO_2$, SiTaOx, SiZrOx and SiHfOx and on which the surface treatment layer is to be formed. Specific examples of the method for forming the surface treatment layer 121 include thin film forming methods such as vapor deposition methods, sputtering methods, CVD methods, and ALD methods.

(Ink)

Next, ink for use in the liquid ejection head of this disclosure will be described in detail.

The ink includes at least water, a water-soluble organic solvent, a surfactant, and a colorant, and optionally includes other components if desired.

The water-soluble organic solvent includes at least a water-soluble amide compound, and optionally includes a water-soluble organic solvent (such as the below-mentioned water-soluble organic solvents), hi this regard, water-soluble amide compounds are polar solvents capable of dissolving various organic compounds and inorganic salts, and are compatible with water and organic solvents. Therefore, water-soluble amide compounds can enhance wettability of the ink to recording media, and solubility and compatibility of other ink components.

Specific examples of such water-soluble amide compounds include cyclic amide compounds such as 2-pyrrolidone (having a boiling point of 250° C.), N-methyl-2-pyrrolidone (having a boiling point of 202° C.), 1,3-dimethyl-2-imidazolidinone (having a boiling point of 226° C.), ϵ-caprolactam (having a boiling point of 270° C.), and γ-butyrolactone (having a boiling point of from 204 to 205° C.); and non-cyclic amide compounds such as formamide (having a boiling point of 210° C.), N-methylformamide (having a boiling point of from 199 to 201° C.), N,N-dimethylformamide (having a boiling point of 153° C.), N,N-diethylformamide (having a boiling point of from 176 to 177° C.), and N,N-dimethylacetamide (having a boiling point of 165° C.).

In addition, non-cyclic amide compounds having the following formula (1) can also be used.

$$R3\text{-}O—CH_2—CH_2—CO—N(R1)(R2) \quad (1),$$

wherein each of R1, R2 and R3 represents an alkyl group.

The hydrophilicity of the compounds having the above-mentioned formula changes depending on the length of each of the alkyl groups R1, R2 and R3. Particularly, the hydrophilicity and hydrophobicity of the compounds having formula (1) largely changes depending on the length of the alkyl group R3. When each of the alkyl groups R1, R2 and R3 is a methyl group, the compound cannot be mixed with a liquid paraffin or a n-hexane at a mixing ratio of 1/1. However, when the alkyl group R3 is a n-butyl group, the compound can be mixed with a liquid paraffin or a n-hexane at a mixing ratio of 1/1.

When each of the alkyl groups R1, R2 and R3 is a methyl group (i.e., when the amide compound has the below-mentioned formula (2), the amide compound has a high boiling point of 216° C., and the equilibrium moisture content of the compound at 23° C. and 80% RH is as high as 39.2%. In addition, the viscosity of the amide compound at 25° C. is as low as 1.48 mPa·s. Further, the amide compound can be easily dissolved in water-soluble organic solvents and water, and therefore the ink can have a low viscosity. Therefore, the compound is preferably used as the water-soluble organic solvent of the ink. Ink including the amide compound has a good combination of preservation stability and ejection stability, and is friendly to maintenance/recovery devices of inkjet printers.

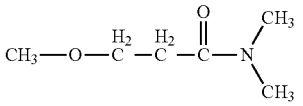

(2)

When the alkyl group is a butyl group, the amide compound is freely dissolved in water while being able to be dissolved in liquid paraffins and n-hexane. In addition, the boiling point of the amide compound is as high as 252° C. Therefore, the amide compound can be used as a penetration enhancing agent or a solubilizing agent to be included in ink.

Since these amide compounds have high solubility, the solubility of the amide compounds in conventional adhesive agents used for preparing liquid ejection heads is also high, and therefore it is difficult to increase the content of such amide compounds in ink. Specifically, the content of such amide compounds in ink used for laminated liquid ejection 1.5 heads, which are prepared using an adhesive agent, is not greater than 10% by weight. If an amide compound is included in ink in a large amount, the adhesive agent used for the liquid ejection head is damaged by the amide compound, thereby causing a problem in that the mechanical strength of the liquid ejection head is deteriorated.

Amide compounds having formula (1) can be included in ink in an amount of not less than 20% by weight when the liquid ejection head uses the liquid repellent layer 121 and the surface treatment layer 120 mentioned above.

The content of such an amide compound in ink is preferably not less than 20% by weight to improve evenness of solid ink images. When the content is greater than 60% by weight, problems such that drying property of ink images formed on recording papers deteriorates, and qualities of character images formed on recording papers deteriorate are often caused.

Suitable water-soluble organic solvents for use in combination with such amide compounds as mentioned above include water-soluble organic solvents including at least one polyalcohol having an equilibrium moisture content of not less than 30% by weight at 23° C. and 80% RH. It is preferable that the water-soluble organic solvent in the ink includes a wetting agent A, which has a high equilibrium moisture content (for example, not less than 30% (preferably not less than 40%) by weight at 23° C. and 80% RH) and a high boiling point (for example, not lower than 250° C.), and a wetting agent B, which has a high equilibrium moisture content (for example, not less than 30% by weight at 23° C. and 80% RH) and a relatively low boiling point (for example, from 140 to 250° C.).

Specific examples of polyalcohols for use as the wetting agent A (having a boiling point of not lower than 250° C. at normal pressure) include 1,2,3-butanetriol (having a boiling point of 175° C. at 33 hPa, and an equilibrium moisture content of 38% by weight), 1,2,4-butanetriol (having a boiling point of 190-191° C. at 2411 Pa, and an equilibrium moisture content of 41% by weight), glycerin (having a boiling point of 290° C., and an equilibrium moisture content of 49% by weight), diglycerin (having a boiling point of 270° C. at 20 hPa, and an equilibrium moisture content of 38% by weight), triethylene glycol (having a boiling point of 285° C., and an equilibrium moisture content of 39% by weight), and tetraethylene glycol (having a boiling point of 324-330° C., and an equilibrium moisture content of 37% by weight).

Specific examples of polyalcohols for use as the wetting agent B (having a boiling point of from 140 to 250° C.) include diethylene glycol (having a boiling point of 245° C., and an equilibrium moisture content of 43% by weight), and 1,3-butanediol (having a boiling point of 203-204° C., and an equilibrium moisture content of 35% by weight).

In this regard, each of the wetting agents A and B has high moisture absorbency such that the equilibrium moisture content at 23° C. and 80% RH is not less than 30% by weight, and the wetting agent B has a relatively high evaporativity compared to the wetting agent A. Among various combinations of a wetting agent A and a wetting agent B, a combination of glycerin and 1,3-butanediol is preferable.

When a combination of a wetting agent A and a wetting agent B is used, the weight ratio (B/A) of the wetting agent B to the wetting agent A is preferably from 10/90 to 90/10 although the weight ratio changes depending on choice of other additives and the added amounts of the additives.

The equilibrium moisture content of a compound is measured by the following method.

(1) A petri dish containing one gram of the compound, whose weight (W1) is measured precisely, is set in a desiccator in which a saturated aqueous solution of potassium chloride and sodium chloride is contained to control the environmental condition in the desiccator so as to be 23±1° C. and 80±3% RH.

(2) After the water content of the compound saturates (i.e., the weight of the compound becomes constant), the weight (W2) of the compound is measured precisely to determine the equilibrium moisture content of the compound.

In this regard, the equilibrium moisture content (EMC) of the compound can be determined by the following equation.

$$\text{EMC(\% by weight)}=\{(W2-W1)/W2\}\times 100$$

When such a polyalcohol is included in the ink in an amount of not less than 50% of the total weight of the water-soluble organic solvent, the ink has good ejection stability and occurrence of a problem in that waste ink is fixedly adhered to a maintenance device for an ink ejecting device of an inkjet recording apparatus can be prevented.

The ink can further include another organic solvent in addition to the wetting agents A and B or instead of part of the wetting agents A and B. Specific examples of such an organic solvent include polyalcohols, polyalcohol alkyl ether compounds, polyalcohol aryl ether compounds, amine compounds, sulfur-containing compounds, propylene carbonate, ethylene carbonate, and other water-soluble organic solvents.

Specific examples of such polyalcohols include dipropylene glycol (having a boiling point of 232° C.), 1,5-pentanediol (having a boiling point of 242° C.), 3-methyl-1,3-butanediol (having a boiling point of 203° C.), propylene glycol (having a boiling point of 187° C.), 2-methyl-2,4-pentanediol (having a boiling point of 197° C.), ethylene glycol (having a boiling point of from 196 to 198° C.), tripropylene glycol (having a boiling point of 267° C.), hexylene glycol (having a boiling point of 197° C.), polyethylene glycol (viscous liquid or solid), polypropylene glycol (having a boiling point of 187° C.), 1,6-hexanediol (having a boiling point of from 253 to 260° C.), 1,2,6-hexanetriol (having a boiling point of 178° C.), trimethylol ethane (solid having a melting point of from 199 to 201° C.), and trimethylol propane (solid having a melting point of 61° C.).

Specific examples of the above-mentioned polyalcohol alkyl ether compounds include ethylene glycol monoethyl ether (having a boiling point of 135° C.), ethylene glycol monobutyl ether (having a boiling point of 171° C.), diethylene glycol monomethyl ether (having a boiling point of 194° C.), diethylene glycol monoethyl ether (having a boiling point of 197° C.), diethylene glycol monobutyl ether (having a boiling point of 231° C.), ethylene glycol mono-2-ethylhexyl ether (having a boiling point of 229° C.), and propylene glycol monoethyl ether (having a boiling point of 132° C.).

Specific examples of the above-mentioned polyalcohol aryl ether compounds include ethylene glycol monophenyl ether (having a boiling point of 237° C.), and ethylene glycol monobenzyl ether.

Specific examples of the above-mentioned amine compounds include monoethanolamine (having a boiling point of 170° C.), diethanolamine (having a boiling point of 268° C.), triethanolamine (having a boiling point of 360° C.), N,N-dimethylmonoethanolamine (having a boiling point of 139° C.), N-methyldiethanolamine (having a boiling point of 243° C.), N-methylethanolamine (having a boiling point of 159° C.), N-phenylethanolamine (having a boiling point of from 282 to 287° C.), and 3-aminopropyldiethylamine (having a boiling point of 169° C.).

Specific examples of the above-mentioned sulfur-containing compounds include dimethylsulfoxide (having a boiling point of 139° C.), sulfolane (having a boiling point of 285° C.), and thiodiglycol (having a boiling point of 282° C.).

Other wetting agents such as saccharide can be used for the ink. Such saccharide is classified into monosaccharide, disaccharide, oligosaccharide (including tri- or tetra-saccharide) and polysaccharide. Specific examples of such saccharide include glucose, mannose, fructose, ribose, xylose, arabinose, galactose, maltose, cellobiose, lactose, sucrose, trehalose and maltotriose.

In this regard, polysaccharide means saccharide in a broad sense, and is defined to include materials present in nature such as α-cyclodextrin, and cellulose.

Derivatives of saccharide can also be used. Specific examples thereof include reduction materials of the saccharide mentioned above (e.g., sugar alcohols (having a general formula $HOCH_2(CHOH)_nCH_2OH$, wherein n is an integer of from 2 to 5)), oxidation materials of the saccharide mentioned above (e.g., aldonic acid, and uronic acid), amino acids, and thio acids.

Among these materials, sugar alcohols are preferable. Specific examples of such sugar alcohols include maltitol and sorbit.

The ink includes a colorant. Pigments (such as inorganic pigments and organic pigments) are preferably used as the colorant from the viewpoint of weather resistance of the ink. In this regard, dyes can be used in combination with pigments to adjust the color tone, but it is necessary to add a dye in such an amount as not to deteriorate the weather resistance of the ink.

Specific examples of the above-mentioned inorganic pigments include titanium oxide, iron oxide, calcium carbonate, barium sulfate, aluminum hydroxide, barium yellow, cadmium red, chrome yellow, and carbon blacks, which are prepared by any known methods such as contact methods, furnace methods, and thermal methods.

Specific examples of the above-mentioned organic pigments include azo pigments (e.g., azo lakes, insoluble azo pigments, condensed azo pigments, and chelated azo pigments), polycyclic pigments (e.g., phthalocyanine pigments, perylene pigments, perynone pigments, anthraquinone pigments, quinacridone pigments, dioxazine pigments, indigo pigments, thioindigo pigments, isoindolinone pigments, and quinophthalone pigments), chelated dyes (e.g. basic dye-type chelates, and acidic dye-type chelates), nitro pigments, nitroso pigments, and aniline black. Among these pigments, pigments having good affinity for water are preferably used.

Among these pigments, pigments subjected to surface modification such that at least one hydrophilic group is connected with the surface of the pigments with or without an intervening group therebetween are preferable. In this regard, the surface modification is performed by chemically bonding a specific functional group (such as sulfonic acid group and carboxyl group) to the surface of a pigment, or by subjecting a pigment to a wet oxidation treatment using a hypohalous acid and/or a salt thereof. Among these pigments, pigments in which a carboxyl group is bonded to the surface of the pigments and which are dispersed in water are preferable. Since such pigments are subjected to surface modification and a carboxyl group is bonded to the surface of the pigments, the pigments can be stably dispersed in the ink, and therefore high quality images can be produced. In addition, water resistance of the images printed on recording media can be further enhanced.

Further, an ink including such a pigment as mentioned above has good re-dispersibility such that even when the ink in an inkjet head is not used for a log period of time and water in the ink in the vicinity of inkjet nozzles evaporates, occurrence of a nozzle clogging problem in that the inkjet nozzles are clogged with the dried ink can be prevented and high quality images can be formed by performing a simple inkjet head cleaning operation. In addition, when such a self-dispersing pigment is used in combination with a surfactant and a penetrant (mentioned later), a synergy effect can be produced, and thereby high quality images can be reliably produced.

Polymer emulsions containing polymer particles including a pigment can also be used as the pigment. In this regard, the polymer emulsions are emulsions in which polymer particles including a pigment therein or polymer particles, on which a pigment is adsorbed, are dispersed. In this regard, it is not necessary that all the polymer particles include a pigment therein or a pigment is adsorbed on all the polymer particles, and particles of the pigment may be dispersed in the emulsion (in the medium) as long as the effect can be produced by using the colorant. Suitable polymers for use in preparing the polymer emulsion include vinyl polymers, polyesters, and polyurethanes. Among these polymers, vinyl polymers, and polyesters are preferable.

Water-soluble dyes can be used for the colorant in combination with pigments. Among various water-soluble dyes, acidic dyes and direct dyes are preferable.

The added amount of a colorant in the ink is preferably from 1 to 15% by weight, and more preferably from 3 to 12% by weight.

The ink preferably includes a surfactant such as anionic surfactants, nonionic surfactants, and ampholytic surfactants. One or more proper surfactants are selected from these surfactants in consideration of the properties of the colorant, the wetting agent and the water-soluble organic solvent to be used for the ink so that the resultant ink has good dispersibility.

Specific examples of the above-mentioned anionic surfactants include polyoxyethylene alkyl ether acetates, alkylbenzene sulfonates, sulphonic acid salts of succinic acid esters, laurates, and polyoxyethylene alkyl ether sulfates.

Specific examples of the above-mentioned nonionic surfactants include polyoxyethylene alkyl ethers, polyoxyethylenepolyoxypropylene alkyl ethers, polyoxyethylene alkyl esters, polyoxyethylenepolyoxypropylene alkyl esters, polyoxyethylene sorbitan fatty acid esters, polyoxyethylene alkylphenyl ethers, polyoxyethylene alkylamines, and polyoxyethylene alkylamides.

Specific examples of the above-mentioned ampholytic surfactants include salts of laurylaminopropionic acid, lauryldimethylbetaine, stearyldimethylbetaine, and lauryldihydroxyethylbetaine. Specifically, the following surfactants are preferably used, but the surfactant is not limited thereto.

Lauryldimethylamine oxide, myristyldimethylamine oxide, stearyldimethylamine oxide, dihydroxyethyllayrylamine oxide, polyoxyethylenecoconut oil alkyldimethylamine oxide, dimethylalkyl(coconut oil)betaine, and dimethyllaurylbetaine.

In addition, acetylene glycol surfactants can be used. Specific examples thereof include 2,4,7,9-tetramethyl-5-decine-4,7-diol, 3,6-dimethyl-4-octine-3,6-diol, and 3,5-dimethyl-1-hexyne-3-ol. Specific examples of marketed products thereof include SURFYNOLs 104, 82, 465, 485 and TG from Air Products And Chemicals, Inc. Among these, SURFYNOLs 465, 104 and TG are preferable because the resultant ink can produce high quality images.

Fluorine-containing surfactants can also be used. Specific examples of such fluorine-containing surfactants include salts of perfluoroalkylsulfonic acids, salts of perfluoroalkylcarboxylic acids, esters of perfluoroalkylphosphoric acids, adducts of perfluoroalkylethylene oxide, perfluoroalkylbetaine, perfluoroalkyamine oxide compounds, polyoxyalkylene ether polymers having a perfluoroalkylether group in a side chain thereof and sulfuric acid ester salts thereof, and fluorine-containing aliphatic polymer esters.

Specific examples of marketed products of such fluorine-containing surfactants include SARFRONs S-111, S-112, S-113, S-121, S-131, S-132, S-141 and S-145 (from Asahi Glass Co., Ltd; FLUORADs FC-93, FC-95, FC-98, FC-129, FC-135, FC-170C, FC-430, FC-431 and FC-4430 (from Sumitomo 3M Ltd.); FT-110, 250, 251 and 400S (from Neos Co., Ltd.); ZONYLs FS-62, FSA, FSE, FSJ, FSP, TBS, UR, FSO, FSO-100, FSN, FSN-100, FS-300 and FSK (from Du Pont); and POLYFOXs PF-136A, PF-156A and PF-151N (from Om Nova Solutions, Inc.).

The above-mentioned surfactants can be used alone or in combination. In addition, the surfactant included in the ink is not limited to the surfactants. Even when a surfactant is not easily dissolved in the ink, there is a case in which the surfactant is solubilized in the ink when the surfactant is used in combination with another surfactant.

In order that the ink has good penetrating property, the total content of surfactants included in the ink is preferably from 0.01 to 5% by weight based on the weight of the ink. When the content is less than 0.01% by weight, the effect of the surfactant cannot be produced. In contrast, when the content is greater than 5%, the ink has too high penetrating property to recording media, thereby causing problems in that the image density decreases and the ink penetrates into the backside of a recording medium. Therefore, in order to form high quality images on various recording papers having different physical properties, the content of surfactants is preferably from 0.5 to 2% by weight.

The ink preferably includes a penetrant. Among various penetrants, one or more polyols having a solubility in water of not less than 0.2% by weight and less than 5.0% by weight at 20° C. are preferably used as the penetrant.

Specific examples of such polyols include aliphatic polyols such as 2-ethyl-2-methyl-1,3-propanediol, 3,3-dimethyl-1,2-butanediol, 2,2-diethyl-1,3-propanediol, 2-methyl-2-propyl-1,3-propanediol, 2,4-dimethyl-2,4-pentanediol, 2,5-dimethyl-2,5-hexanediol, 5-hexene-1,2-diol, 2-ethyl-1,3-hexanediol and 2,2,4-trimethyl-1,3-pentanediol.

Among these polyols, 2-ethyl-1,3-hexanediol and 2,2,4-trimethyl-1,3-pentanediol are preferable.

Other penetrants can be used in combination with the above-mentioned penetrants. Specific examples thereof include alkyl ethers or aryl ethers of polyalcohols such as diethylene glycol monophenyl ether, ethylene glycol monophenyl ether, ethylene glycol monoalkyl ether, diethylene glycol monobutyl ether, propylene glycol monobutyl ether, and tetraethylene glycol chlorophenyl ether; and lower alcohols such as ethanol. However, the penetrant is not limited thereto, and any materials can be used as long as the materials are dissolved in the ink and the resultant ink has desired physical properties.

Even when a material has a low solubility in water, the material can be used as a penetrant if the material is solubilized by such an amide compound as mentioned above to an extent such that the material does not precipitate in the ink. Since conventional inks include such an amide compound in a relatively small amount, the solubilization effect is hardly produced. However, the above-mentioned ink for use in the image forming apparatus includes such an amide compound in a relatively large amount, materials, which cannot be used as penetrants because of having a low solubility in water, can be used for the ink. Therefore, this ink can be used for coated papers for printing, into which conventional inks hardly penetrate.

The added amount of a penetrant in the ink is preferably from 0.1 to 4.0% by weight based on the weight of the ink. When the added amount is less than 0.1% by weight, quick-drying property cannot be imparted to the ink, thereby forming blurred ink images. In contrast, when the added amount is greater than 4.0% by weight, the dispersion stability of a colorant in the ink deteriorates, thereby causing the nozzle clogging problem mentioned above and another problem in that the ink has too high penetrating property, and therefore the image density decreases and the ink penetrates into the backside of recording media.

The ink preferably includes a water-dispersible resin such as condensation-type synthetic resins, addition-type synthetic resins, and natural polymeric compounds.

Specific examples of such condensation-type synthetic resins include polyester resins, polyurethane resins, epoxy resins, polyamide resins, polyether resins, and silicone resins. Specific examples of such addition-type synthetic resins include polyolefin resins, polystyrene resins, polyvinyl alcohol resins, polyvinylester resins, acrylic resins, and unsaturated carboxylic acid resins. Specific examples of such natural polymeric compounds include cellulose resins, rosins and natural rubbers. The resins may be homopolymers, copolymers or complex resins. In addition, any emulsions having a single phase structure or a core-shell structure, or power-feed emulsions can be used.

Aqueous dispersions of self-dispersible resins having a hydrophilic group, and aqueous dispersions of resins which do not have self-dispersibility and which are dispersed in an aqueous medium using a surfactant or a resin having a hydrophilic group can be used for the above-mentioned aqueous resin dispersions. Among these aqueous resin dispersions, resin emulsions including particulate resins such as ionomers of polyester resins and polyurethane resins, and resins prepared by subjecting unsaturated monomers to emulsion polymerization or suspension polymerization are preferably used.

When preparing resin emulsions by subjecting an unsaturated monomer to emulsion polymerization, methods in which components such as an unsaturated monomer, a polymerization initiator, a surfactant, a chain transfer agent, a chelating agent, and a pH controlling agent are reacted in water are typically used. Therefore, aqueous resin emulsions can be easily prepared. In addition, since the composition of resins can be easily changed, resin dispersions having desired properties can be prepared relatively easily.

Suitable materials for use as the unsaturated monomer include unsaturated carboxylic acid monomers, (meth) acrylic acid ester monomers, (meth)acrylic acid amide monomers, aromatic vinyl monomers, vinylcyano monomers, vinyl monomers, allyl compounds, olefin monomers, diene monomers, and oligomers having unsaturated carbon, which can be used alone or in combination. By using such monomers and oligomers alone or in combination, the properties of the resultant resins can be modified flexibly. In addition, by performing polymerization reactions or graft reactions using an oligomer-type polymerization initiator, the properties of the resultant resins can be modified.

It is possible to freely modify the properties of a water-dispersible resin by using a method in which one or more unsaturated monomers and a polymerization initiator are used to prepare a resin. When dispersions of such water-dispersible resins are present under strong alkaline or acidic conditions, the dispersions are destroyed or subjected to molecular chain cutting such as hydrolysis. Therefore, the pH of the aqueous resin dispersions is preferably from 4 to 12. From the viewpoint of miscibility with water-dispersing colorants, the pH is more preferably 6 to 11, and even more preferably from 7 to 9.

The average particle diameter of the above-mentioned aqueous resin dispersions relates to the viscosity thereof, and as the particle diameter of an aqueous resin dispersion decreases, the viscosity of the aqueous dispersion increases when the solid content of the dispersion and the formula of the resin are the same. In order that the resultant ink does not have an excessively high viscosity, the average particle diameter of the aqueous resin dispersion used for the ink is preferably not less than 50 nm. When the particle diameter is on the order of tens of micrometers, the resin particles are larger than the diameter of popular inkjet nozzles, and therefore the aqueous resin dispersion cannot be used for the ink. Even when the average particle diameter of an aqueous resin dispersion is less than the diameter of inkjet nozzles, the ejection property of the ink deteriorates if the resin dispersion includes resin particles having a particle diameter larger than the diameter of inkjet nozzles. Therefore, the average particle diameter of the aqueous resin dispersion used for the ink is preferably not greater than 500 nm, and more preferably not greater than 150 nm.

Such an aqueous resin dispersion as included in the ink is desired to have a function to enhance the fixability of the colorant in the ink to recording media such as papers by forming a resin film at room temperature. Therefore, the aqueous resin dispersion preferably has a minimum film forming temperature (MFT) of not higher than room temperature, and more preferably not higher than 20° C. However, when the glass transition temperature of the resin of the aqueous resin dispersion is lower than −40° C., a film of the resin becomes viscous, and the resultant ink images have tackiness. Therefore, the glass transition temperature of the resin of the aqueous resin dispersion is preferably not lower than −30° C.

The ink for use in the image forming apparatus of this disclosure can optionally include other components such as pH controlling agents, antiseptics/fungicides, chelating agents, anti-rust agents, antioxidants, ultraviolet absorbents, oxygen absorbents, light stabilizers, and defoaming agents.

The pH controlling agent is not particularly limited, and pH controlling agents, which do not adversely affect the ink and which can control the pH of the ink in a pH range of front 7 to 11, can be used for the ink. Suitable materials for use as the pH controlling agent include alcohol amines, hydroxides of alkali metals, ammonium hydroxides, phosphonium hydroxides, and carbonates of alkali metals.

When the pH of the ink is lower than 7 or higher than 11, the ink tends to easily dissolve ink ejection heads and ink supplying units, thereby causing problems such that the properties of the ink are changed; the ink is leaked from the ink ejection heads and the ink supplying units; and the ink is defectively ejected from the inkjet heads.

Specific examples of the alcohol amines include diethanolamine, triethanolamine, and 2-amino-2-ethyl-1,3-propanediol.

Specific examples of the hydroxides of alkali metals include lithium hydroxide, sodium hydroxide, and potassium hydroxide.

Specific examples of the ammonium hydroxides include ammonium hydroxide, quaternary ammonium hydroxide, and quaternary phosphonium hydroxide.

Specific examples of the carbonates of alkali metals include lithium carbonate, sodium carbonate, and potassium carbonate.

Specific examples of the antiseptics/fungicides include sodium dehydroacetate, sodium sorbate, sodium salt of 2-pilidinethiol-1-oxide, sodium benzoate, and sodium salt of pentachlorophenol.

Specific examples of the chelating agents include sodium salt of ethylenediamine tetraacetic acid, sodium salt of nitrilotriacetic acid, sodium salt of hydroxyethylethylenediaminetriacetic acid, sodium salt of diethylenetriaminepentaacetic acid, and sodium salt of uramildiacetic acid.

Specific examples of the anti-rust agents include acidic sulfites, sodium thiosulfate, ammonium thioglycolate, diisopropylammonium nitrite, pentaerythritol tetranitrate, and dicyclohexylammonium nitrite.

Suitable materials for use as the antioxidants include phenolic antioxidants (including hindered phenol type antioxidants), amine type antioxidants, sulfur-containing antioxidants, and phosphorus-containing antioxidants.

Suitable materials for use as the ultraviolet absorbents include benzophenone type ultraviolet absorbents, benzotriazole type ultraviolet absorbents, salicylate type ultraviolet absorbents, cyanoacrylate type ultraviolet absorbents, and nickel complex type ultraviolet absorbents.

Suitable materials for use as the defoaming agents include silicone defoaming agents, polyether defoaming agents, and fatty acid ester defoaming agents. In addition, general defoaming agents can also be used in combination with the above-mentioned defoaming agents. In this regard, when a defoaming agent including a large amount of particulate inorganic material is used in combination to enhance the defoaming effect, it is preferable that the amount of coarse particles having a particle diameter of not less than 0.5 am included in the ink is not greater than $3.0\times10^7$ pieces per 5 μl and the amount of coarse particles having a particle diameter of from 1 μm to 5 μm is not greater than 1% by number. When coarse particles of a particulate inorganic material having such a particle diameter are included in the ink in an amount of not less than the above-mentioned range, it is preferable to properly remove the coarse particles from the ink.

The ink for use in the image forming apparatus of this disclosure is typically prepared by dispersing or dissolving ink components such as a colorant, a water-soluble organic solvent (wetting agent), a surfactant, a penetrant, a water-dispersible resin, and other optional components in an aqueous medium including water while mixing the components, and then optionally agitating the mixture using a mixer such as a sand mill, a homogenizer, a ball mill, a paint shaker, and a supersonic dispersing machine. This mixing and agitating operation can also be performed by an agitator having an agitating blade, a magnetic stirrer, and a high speed dispersing machine.

The physical properties of the ink are not particularly limited, and are properly determined so that the ink can be satisfactorily used for targeted image forming apparatuses. It is preferable that the viscosity and the surface tension of the ink fall in the ranges mentioned The ink preferably has a viscosity of from 3 to 20 mPa·s at 25° C.

When the ink has a viscosity of not less than 3 mPa·s, effects to enhance the image density and the character image quality can be produced. In addition, when the ink has a viscosity of not greater than 20 mPa·s, the ink has good ejection property. In this regard, the viscosity is measured at 25° C. using a viscometer such as RL-550 from Toki Sangyo Co., Ltd.

The ink preferably has a surface tension of not greater than 35 mN/m at 25° C., and more preferably not greater than 32 mN/m. When the surface tension is greater than 35 mN/m, the ink cannot be satisfactorily leveled on recording media, thereby increasing the drying time of ink images.

The color of the ink is not particularly limited, and is determined based on the application of the ink. For example, yellow, magenta, cyan and black color inks can be used. By using two or more of these color inks, multi-color images can be formed. In addition, by using all the color inks, full color images can be formed.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Surface Treatment Layer Preparation Examples

A nozzle substrate was subjected to a surface treatment to prepare a sample for use in the peeling test and the ink dissolution test mentioned below. The surface treatment layer was a $SiO_2$ layer in which an element such as Al, Zr, Ta, Ti and W is included. By changing the content of the element, fourteen samples were prepared as described in Table 1 below.

The method for forming the surface treatment layer is the following multi-element sputtering method. Specifically, targets of Si and one of the elements Al, Zr, Ta, Ti and W were set in the sputtering device, and the powers applied to the targets were adjusted to adjust the ratio of Si to Al, Zr, Ta, Ti or W. Thus, fourteen surface treatment layers were prepared.

The formulae of the surface treatment layers are illustrated in Tables 1-1 and 1-2 below. In Tables 1-1 and 1-2, the unit at % means atomic percent.

TABLE 1-1

| Element | Ion and radius thereof (pm) | Surface Treatment Layer Preparation Example 1 | 2 | 3 | 4 | 5 | 6 | 7 |
|---|---|---|---|---|---|---|---|---|
| Zr | $Zr^{4+}$ 80 | — | — | — | — | 2 at % | 5 at % | 10 at % |
| Ta | $Ta^{5+}$ 76 | — | — | — | — | — | — | — |
| Ti | $Ti^{4+}$ 68 | — | — | — | 10 at % | — | — | — |
| W | $W^{6+}$ 66 | — | — | 10 at % | — | — | — | — |
| Al | $Al^{3+}$ 50 | — | 10 at % | — | — | — | — | — |
| Si | $Si^{4+}$ 41 | 33 at % | 25 at % | 17 at % | 23 at % | 32 at % | 28 at % | 23 at % |

TABLE 1-2

| Element | Ion and radius thereof (pm) | Surface Treatment Layer Preparation Example 8 | 9 | 10 | 11 | 12 | 13 | 14 |
|---|---|---|---|---|---|---|---|---|
| Zr | $Zr^{4+}$ 80 | 15 at % | 20 at % | — | — | — | — | — |
| Ta | $Ta^{5+}$ 76 | — | — | 2 at % | 5 at % | 10 at % | 15 at % | 20 at % |
| Ti | $Ti^{4+}$ 68 | — | — | — | — | — | — | — |
| W | $W^{6+}$ 66 | — | — | — | — | — | — | — |
| Al | $Al^{3+}$ 50 | — | — | — | — | — | — | — |
| Si | $Si^{4+}$ 41 | 18 at % | 13 at % | 31 at % | 27 at % | 21 at % | 16 at % | 10 at % |

Inkjet Ink Preparation Example

1. Preparation of Polymer A

After air inside a 1-liter flask equipped with a mechanical agitator, a thermometer, a nitrogen feed pipe, a reflux condenser, and a dropping funnel was substituted with a nitrogen gas, the following components were mixed in the flask.

| | |
|---|---|
| Styrene | 11.2 g |
| Acrylic acid | 2.8 g |
| Lauryl methacrylate | 12.0 g |
| Polyethylene glycol methacrylate | 4.0 g |
| Styrene macromer | 4.0 g |
| Mercaptomethanol | 0.4 g |

The mixture was heated to 65° C.

Next, a mixture of the following components was dropped into the flask over 2.5 hours using the dropping funnel.

| | |
|---|---|
| Styrene | 100.8 g |
| Acrylic acid | 25.2 g |
| Lauryl methacrylate | 108.0 g |
| Polyethylene glycol methacrylate | 36.0 g |
| Hydroxyethyl methacrylate | 60.0 g |
| Styrene macromer | 36.0 g |
| Mercaptomethanol | 3.6 g |
| Azobismethylvaleronitrile | 2.4 g |
| Methyl ethyl ketone | 18 g |

Further, a mixture of 0.8 g of azobismethylvaleronitrile azobismethylvaleronitrlle and 18 g of methyl ethyl ketone was dropped into the flask over 0.5 hours using the dropping funnel.

After the mixture was heated for 1 hour at 65° C. to be aged, 0.8 g of azobismethylvaleronitrile was fed into the flask, and the mixture was further aged for 1 hour. After the reaction, 364 g of methyl ethyl ketone was fed into the flask to prepare 800 g of a polymer solution A having a solid content of 50% by weight.

2. Preparation of Aqueous Dispersion of Pigment-Containing Particulate Polymer

The following components were mixed while agitated.

| | |
|---|---|
| Polymer solution A | 28 g |
| C.I. Pigment blue 15:3 | 26 g |
| 1 mol/L Aqueous solution of potassium hydroxide | 13.6 g |
| Methyl ethyl ketone | 20 g |
| Ion-exchange water | 13.6 g |

The mixture was kneaded by a roll mill. The thus prepared paste was fed into 200 g of pure water, and the mixture was agitated. Thereafter, methyl ethyl ketone and water were distilled away from the mixture using an evaporator. Thus, an aqueous dispersion of a cyan polymer including the pigment in an amount of 20% by weight was prepared.

3. Preparation of Pigment/Resin Dispersion

The following components were mixed while agitated.

| | |
|---|---|
| Styrene-acrylic polymer | 7.7 g |

(JONCRYL 679 from BASF having a molecular weight of 7,000 and an acid value of 200 mgKOH/g)

| | |
|---|---|
| Triethanolamine | 22.5 g |
| 2-Propanol | 0.8 g |
| Pure water | 331 g |

Next, 155 g of Pigment Blue 15:3 was added to the mixture while agitated, and the mixture was subjected to a dispersing treatment for 2 hours using a bead mill. Further, 483 g of pure water was added to the mixture, and the mixture was subjected to ultracentrifugal separation to remove coarse particles therefrom. Thus, a cyan-pigment/resin dispersion including the cyan pigment in an amount of 15.5% by weight was prepared.

4. Preparation of Inks

Ink Preparation Examples 15-18

The formulae of the inks of Ink Preparation Examples 15-18 are illustrated in Table 2 below. The ink preparation method is the following, but is not limited thereto, Specifically, a wetting agent, a penetrant, a surfactant, and water were mixed and agitated for 1 hour. Next, a colorant, and a defoaming agent were added to the mixture, and the mixture was agitated for 1 hour to prepare a dispersion. The dispersion was subjected to pressure filtration using a cellulose acetate membrane filter having openings of 0.8 μm to remove coarse particles and foreign materials.

TABLE 2

| | | | Ink Preparation Example | | | |
|---|---|---|---|---|---|---|
| | | | 15 | 16 | 17 | 18 |
| Colorant | | C1 | — | 28.3 | — | — |
| | | C2 | — | — | 25.0 | 20.0 |
| | | C3 | 25.8 | — | — | — |
| Solvent | Amide-type wetting agent | S1 | 25.0 | — | — | — |
| | | S2 | — | 5.0 | 15.0 | — |
| | | S3 | — | 5.0 | 10.0 | — |
| | | S4 | — | 20.0 | — | 30.0 |
| | Alcohol-type wetting agent | S5 | 10.0 | 5.0 | 10.0 | 10.0 |
| | | S6 | 5.0 | 10.0 | 5.0 | 10.0 |
| | penetrant | S7 | 2.0 | — | 4.0 | — |
| | | S8 | — | 2.0 | — | 2.0 |
| Surfactant | | SU1 | — | 0.5 | 1.0 | — |
| | | SU2 | 1.0 | — | — | 0.5 |
| Water | | | 31.2 | 24.2 | 30.0 | 27.5 |
| Total | | | 100.0 | 100.0 | 100.0 | 100.0 |

C1: Black aqueous liquid of disazo dye, BAYSCRIPT BLACK SP LIQUID from LANXESS
C2: Aqueous dispersion of pigment-containing particulate polymer prepared above
C3: Pigment/resin dispersion prepared above
S1: N-methyl-2-pyrrolidone
S2: 2-Pyrrolidone
S3: 3-Dimethyl-2-imidazolidinone
S4: Amide compound having the above-mentioned formula (2)
S5: Glycerin
S6: 1,3-Butanediol
S7: 1,2-Hexanediol
S8: Octanediol
SU1: Polyoxyalkylene alkyl alcohol ether (EMULGEN LS-106 from Kao Corporation)
SU2: BYK-348 from BYK Chemie Japan (mixture of polyglycol and polyether modified polydimethylsiloxane)

Formation of Organic Repellent Layer (for Examples 1-15 and Comparative Examples 1 and 2)

The organic liquid repellent layer 121 was formed by vacuum deposition using a fluorine-containing liquid repellent material.

In this regard, a perfluoropolyether (OPTOOL DSX from DAIKIN INDUSTRIES, Ltd.) was used as the fluorine-containing liquid repellent material, and the thickness of the material was controlled so as to be from 5 nm to 20 nm so that the layer can have good liquid repellency.

After the fluorine-containing liquid repellent material was deposited on the surface treatment layer of the nozzle plate, the nozzle plate was taken from the chamber of the vacuum deposition device. In this case, the fluorine-containing liquid repellent material and the surface treatment layer 120 were hydrolyzed by moisture in the air, and thereby the fluorine-containing material and the surface treatment layer 120 were chemically bonded, resulting in formation of the organic fluorine-containing liquid repellent layer 121.

Examples 1-15 and Comparative Examples 1 and 2

Each of the surface treatment layers 120 of Surface Treatment Layer Preparation Examples 1-14 was formed on a nozzle substrate, and then the organic liquid repellent layer 121 was formed thereon as mentioned above. Thus, nozzle plates 102 of Examples 1-15 and Comparative Examples 1 and 2 were prepared. The nozzle plates 102 were evaluated with respect to the following properties.

1. Receding Contact Angle of the Organic Repellent Layer

The receding contact angle of the organic repellent layer of each nozzle plate 102 was measured using the following expansion and contraction method.

Specifically, a 1 ml glass syringe was filled with a liquid (ink), and air in the syringe and the needle was discharged therefrom. Next, the syringe was pushed by 150 μm using a micrometer to form an ink droplet of about 4.2 μl on the tip of the needle of the syringe. The syringe was lowered so that the ink droplet on the tip of the needle was contacted with the surface of the nozzle plate. Next, the syringe was pushed by 50 μm using the micrometer to supply the ink of about 1.4 μl to the ink droplet on the surface of the nozzle plate. In this case, the droplet was expanded, and the contact diameter of the ink droplet was increased. Thereafter, the ink of the ink droplet on the surface of the nozzle plate was sucked by the syringe using the micrometer at a speed of about 10 μm/s until the contact diameter of the ink droplet started to decrease. After slopping suction of the ink, the contact angle of the ink droplet on the nozzle plate was measured.

2. Wiping Test (Evaluation of Adhesiveness (Durability) of the Organic Liquid Repellent Layer)

The durability of the organic liquid repellent layer 121 was evaluated by a wiping test. The method of the wiping test is the following.

Specifically, a liquid (ink) of 25 μl was dropped on the surface of the organic liquid repellent layer of the nozzle plate. A rubber pad was pressed to the droplet on the organic repellent layer at a pressure of 3N. The rubber pad was subjected to a back-and-forth movement 300 times at a speed of 100 mm/s while pressed to the organic repellent layer to rub the surface of the organic repellent layer. After the nozzle plate was taken from the tester, the liquid (ink) was removed from the surface of the organic repellent layer. The receding contact angle of the rubbed portion of the surface of the organic repellent layer was measured by the method mentioned above.

(1) Initial Adhesiveness

After the wiping test, the receding contact angle of the rubbed portion of the surface of the organic repellent layer was measured by a contact angle measuring instrument from Kyowa Interface Science Co., Ltd. to evaluate the liquid repellency of the organic liquid repellent layer 121 after the wiping test, i.e., to evaluate the adhesiveness of the organic liquid repellent layer 121 to the surface treatment layer 120.

The initial adhesiveness was classified into the following four grades A-D.

A: The receding contact angle is not less than 35°. (Excellent)
B: The receding contact angle is not less than 30°. (Good)
C: The receding contact angle is not less than 25°. (Usable)
D: The receding contact angle is less than 25°. (Unusable)

(2) Reliability in Adhesiveness

The nozzle plate subjected to the initial adhesiveness test mentioned above was subjected to an ink resistance test in which the nozzle plate is dipped in the ink for 2 months at 60° C. Next, the nozzle plate was subjected to the wiping test, followed by measurement of the receding contact angle to evaluate the reliability in adhesiveness of the organic liquid repellent layer 121 to the surface treatment layer 120.

The reliability in adhesiveness was classified into the following four grades A-D.

A: The receding contact angle is not less than 35°. (Excellent)
B: The receding contact angle is not less than 30°. (Good)
C: The receding contact angle is not less than 25°. (Usable)
D: The receding contact angle is less than 25°. (Unusable)

(3) Solubility of Surface Treatment Layer in Ink

Each of the surface treatment layers of Surface Treatment Layer Preparation Examples 1-14, which had a thickness of 50 nm and which was formed on a silicon substrate, was cut so that the cut portions have a size of 1 cm×5 cm to prepare dipping samples.

Each of the dipping samples was dipped into the ink for 2 months at 60° C.

After the dipping test, the thickness of the (residual) surface treatment layer was measured.

The solubility of surface treatment layer in the ink was classified into the following three grades A-C.

A: The thickness of the residual surface treatment layer is not less than 45 nm.
B: The thickness of the residual surface treatment layer is not less than 25 nm.
C: The thickness of the residual surface treatment layer is less than 25 nm.

In an inkjet head, an organic liquid repellent layer formed on a surface treatment layer is contacted with an ink, and the surface treatment layer is not directly contacted with the ink. Therefore, these evaluation data are used for reference.

3. Ejection Property of Inkjet Head

Inkjet heads of Examples 1-15 and Comparative Examples 1 and 2, which have the surface treatment layers described in Tables 3-1, 3-2 and 4 and the organic liquid repellent layer formed on the surface treatment layers were prepared. The inkjet heads were evaluated with respect to the following properties.

(1) Ink Ejection Property

A tube was connected with the inkjet head so that the ink can be supplied to the inkjet head through the tube. After the ink in the inkjet head was sucked from the nozzles for 1 minute at a pressure of 50 kPa, the nozzle surface was subjected to a maintenance treatment, and then a proper negative pressure was formed on the inkjet head so that the ink was ejected from the nozzles of the inkjet head. In this case, the initial ejection rate (i.e., 100×(the number of nozzles from which the ink is ejected)/(the total number of nozzles)) was determined.

The ink ejection property of the inkjet heads was classified into the following three grades A-C.

A: The initial ejection rate is not less than 98%.
B: The initial ejection rate is not less than 90%.
C: The initial ejection rate is less than 90%.

In this regard, inkjet heads having an ejection rate of not less than 98% are usable.

(2) Reliability in Resistance to Ink

Each of the inkjet heads, which was filled with the ink, was allowed to settle for 3 months in a chamber heated to 60° C. After the preservation test, the ink ejection property of the inkjet heads was evaluated by the above-mentioned method.

The reliability in resistance to ink of the inkjet heads was classified into the following three grades A-C.

A: The ejection rate after the preservation test falls in a range, (the initial ejection rate)±5%.

B: The ejection rate after the preservation test falls in a range, (the initial ejection rate)±10%.

C: The ejection rate after the preservation test falls out of the range, (the initial ejection rate)±10%.

In this regard, inkjet heads in grade A or B are usable.

As illustrated in Tables 3-1 and 3-2 below, the surface treatment layers of Surface Treatment Layer Preparation Examples 1-14 are used for Comparative Examples 1, 2 and Examples 1-12, respectively. The evaluation results are also illustrated in Tables 3-1 and 3-2.

In addition, as illustrated in Table 4 below, the inkjet heads having the surface treatment layer of Surface Treatment Layer Preparation Example 12 was contacted with different inks (i.e., inks of ink Preparation Examples 16, 17 and 18 illustrated in Table 2). The evaluation results are also illustrated in Table 4.

TABLE 3-1

| | Comparative Example | | Example | | | | |
|---|---|---|---|---|---|---|---|
| | 1 | 2 | 1 | 2 | 3 | 4 | 5 |
| Surface treatment layer | Ex. 1* | Ex. 2* | Ex. 3* | Ex. 4* | Ex. 5* | Ex. 6* | Ex. 7* |
| Ink used | Ex. 15 | Ex. 15 | Ex. 15 | Ex. 15 | Ex. 15 | Ex. 15 | Ex. 15 |
| Initial adhesiveness | A | B | B | B | A | A | A |
| Reliability in adhesiveness | D | D | C | C | C | A | A |
| Solubility of surface treatment layer in ink | C | C | C | C | B | A | A |
| Ejection property | A | A | A | A | A | A | A |
| Reliability in resistance to ink | C | C | B | B | B | A | A |

Ex. 1*-7*: Surface Treatment Layer Preparation Example 1-7

TABLE 3-2

| | Example | | | | | | |
|---|---|---|---|---|---|---|---|
| | 6 | 7 | 8 | 9 | 10 | 11 | 12 |
| Surface treatment layer | Ex. 8* | Ex. 9* | Ex. 10* | Ex. 11* | Ex. 11* | Ex. 12* | Ex. 13* |
| Ink used | Ex. 15 | Ex. 15 | Ex. 15 | Ex. 15 | Ex. 15 | Ex. 15 | Ex. 15 |
| Initial adhesiveness | C | C | A | A | A | C | C |
| Reliability in adhesiveness | C | C | A | A | A | C | C |
| Solubility of surface treatment layer in ink | A | A | B | A | A | A | A |
| Ejection property | A | A | A | A | A | A | A |
| Reliability in resistance to ink | A | A | B | A | A | A | A |

Ex. 8*-13*: Surface Treatment Layer Preparation Example 8-13

TABLE 4

| | Example | | |
|---|---|---|---|
| | 13 | 14 | 15 |
| Surface treatment layer | Ex. 12* | Ex. 12* | Ex. 12* |
| Ink used | Ex. 16 | Ex. 17 | Ex. 18 |
| Initial adhesiveness | A | A | A |

TABLE 4-continued

| | Example | | |
|---|---|---|---|
| | 13 | 14 | 15 |
| Reliability in adhesiveness | A | A | A |
| Solubility of surface treatment layer in ink | A | A | A |
| Ejection property | A | A | A |
| Reliability in resistance to ink | A | A | A |

Ex. 12*: Surface Treatment Layer Preparation Example 12

Figure 6:
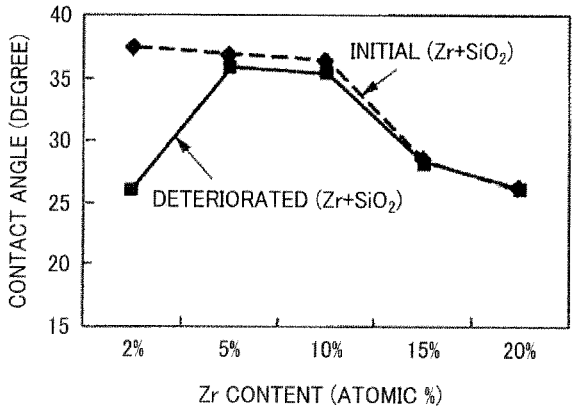
FIG. 6 is a graph illustrating change of contact angle of a Zr-containing $SiO_2$ layer before and after a deterioration test.
Figure 7:
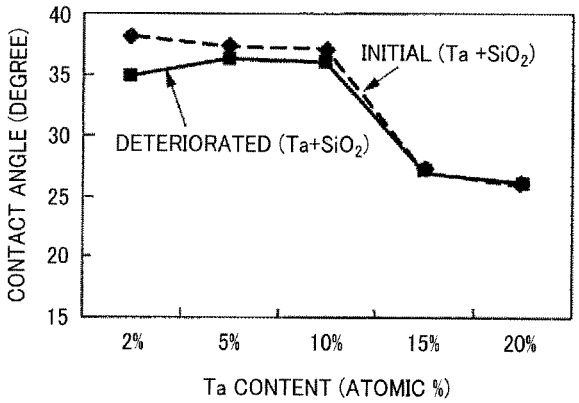
FIG. 7 is a graph illustrating change of contact angle of a Ta-containing Sift layer before and after a deterioration test.

In addition, the receding contact angle of the Zr-containing $SiO_2$ layer and the Ta-containing $SiO_2$ layer before and after a deterioration test (i.e., a preservation test for 2 months at 60° C.) is illustrated in FIGS. 6 and 7.

As a result of the above-mentioned experiments, it is found that the inkjet heads of Comparative Examples 1 and 2 have good initial adhesiveness, but have poor reliability in adhesiveness and resistance to ink. This is because the solubility of the surface treatment layers of the comparative inkjet heads in the inks is high (see Table 3-1), and thereby the interface between the surface treatment layer 120 and the organic liquid repellent layer 121 is corroded by the inks, resulting in deterioration (or loss) of the adhesiveness. In this case, the liquid repellent layer is peeled, and thereby the liquid repellency of the comparative inkjet heads is deteriorated.

When the adhesiveness deteriorates, the liquid repellency of the nozzle portion of the inkjet heads deteriorates, thereby causing the nozzle clogging problem and a problem in that start of ejection of ink droplets ejected by the inkjet heads varies, thereby seriously deteriorating the ejection reliability of the inkjet heads.

In contrast, when an element such as Ti, W, Zr and Ta is included in a $SiO_2$ layer even in a small amount like the inkjet heads of Examples 1, 2, 3 and 10, the reliability in adhesiveness and the reliability in resistance to ink of the inkjet heads can be dramatically enhanced.

FIG. 6 illustrates the reliability in adhesiveness (i.e., contact angle after the deterioration test) of the Zr-containing surface treatment layers ($SiO_2$ layers) of the inkjet heads of Examples 3-7. It is clear from FIG. 6 that by adding Zr in an amount of about 5 atomic %, the reliability in adhesiveness and the reliability in resistance to ink can be dramatically enhanced. In addition, it is clear from FIG. 6 that the curve of contact angle of the deteriorated Zr-containing $SiO_2$ layers has a peak in a certain Zr-content range. The reason therefor is as follows. Specifically, since it is clear from Examples 6 and 7 that the adhesiveness of Zr is lower than that of $SiO_2$, the initial adhesiveness of the Zr-containing surface treatment layer deteriorates (i.e., the contact angle decreases) when the content of Zr increases. Therefore, the contact angle of the Zr-containing surface treatment layer after the deterioration test also decreases. In order that the Zr-containing surface treatment layer has a good combination of initial adhesiveness, reliability in adhesiveness, and reliability in resistance to ink, the Zr content is preferably from about 5 to about 13 atomic %.

FIG. 7 illustrates the reliability in adhesiveness (i.e., contact angle after the deterioration test) of the Ta-containing surface treatment layers ($SiO_2$ layers) of the inkjet heads of Examples 8-13. It is clear from FIG. 7 that by adding Ta in an amount of about 2 atomic %, the reliability in adhesiveness and the reliability in resistance to ink can be dramatically enhanced. In addition, it is clear from FIG. 7 that, similarly to the curve of contact angle of the Zr-containing $SiO_2$ layer, the curve of contact angle of the deteriorated Ta-containing $SiO_2$ layers has a peak in a certain Ta-content range. The reason therefor is the same as that for the Zr-containing $SiO_2$ layer mentioned above.

Since Ta can be connected with O more strongly than Zr, a stable passive layer can be formed, and therefore the resistance to ink of the Ta-containing $SiO_2$ layer is excellent. Specifically, when a $SiO_2$ layer includes Ta in an amount of at least 5 atomic %, the layer can maintain good resistance to ink even after the layer is subjected to the deterioration test for 2 months.

However, since Ta forms a stable passive layer, the initial adhesiveness of the Ta-containing $SiO_2$ layer decreases as the Ta content increases as can be understood from FIG. 7. In order to impart a good combination of initial adhesiveness and reliability in adhesiveness to the organic liquid repellent layer, the Ta content of the Ta-containing $SiO_2$ layer is preferably from 2 to 13 atomic %.

It is clear from FIGS. 6 and 7 that the contact angle of initial surface treatment layers including Ta or Zr in an amount of not greater than 2 atomic % is larger than the contact angle of initial surface treatment layers including Ta or Zr in an amount of not less than 5 atomic %. Namely, as the Ta or Zr content decreases from 5 atomic %, the contact angle increases. This means that a surface treatment layer having a formula similar to that of the Sift layer has good adhesiveness. However, such a surface treatment layer has poor resistance to ink. Namely, the adhesiveness and the reliability in resistance to ink establish tradeoff relationship.

In order to avoid this tradeoff problem, the following second embodiment is effective.

In this first example of the second embodiment, the content of Si in a surface portion of the surface treatment layer 120 (i.e., the interface between the surface treatment layer 120 and the organic liquid repellent layer 121) is increased, and the inner portion of the surface treatment layer includes Ta or Zr at a higher content than the surface portion thereof. In other words, the Si content of the surface portion of the surface treatment layer 120 is controlled so as to be higher than that in the inner portion of the surface treatment layer.

Figure 8:
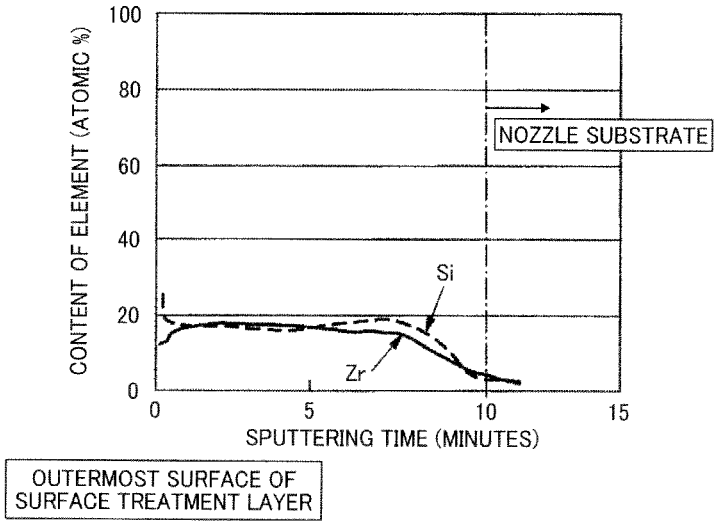
FIGS. 8 and 9 are graphs illustrating the content of elements in a surface treatment layer in a direction (depth direction) of from the outermost surface of the surface treatment layer to the lower member (nozzle substrate)

FIG. 8 illustrates the elemental profile of a SiZrOx surface treatment layer in the depth direction (i.e., in the direction of from the outer surface of the surface treatment layer 120 toward the nozzle substrate 110), which is determined by X-ray photoelectron spectroscopy (XPS). In FIG. 8, only an example in which Zr is included in the surface treatment layer is illustrated. However, the element is not limited thereto, and other elements can also be used.

It is clear from FIG. 8 that the content of Si in the outermost surface portion of the surface treatment layer 120 is higher than that in the other portions of the surface treatment layer.

Specific examples of the method for forming such a surface treatment layer include ALD methods and sputtering (PVD) methods. When an ALD method is used, a procedure in which after forming a $SiO_2$ layer in several steps, a TaOx layer (or a ZrOx layer) is formed thereon in several steps is repeated. Therefore, by changing the ratio of the number of steps, the property of the surface treatment layer can be easily changed. When a sputtering (PVD) method is used, plural targets such as a Si target, a Zr target and a Ta target are used while changing the powers applied to the targets. By using this sputtering method, the property of the surface treatment layer can be easily changed.

Thus, in this example, the content of Si (i.e., the ratio of Si to a transition metal) in the surface treatment layer 120 is higher in the surface portion of the layer than that in the inner portion of the layer. Therefore, the content of $SiO_2$ at the interface between the surface treatment layer 120 and the liquid repellent layer 121 can be increased. In this case, the number of Si—O bonds increases, and therefore formation of Si—OH groups can be easily performed while the wettability of the surface treatment layer 120 with the organic liquid repellent layer 121 can be enhanced. In particular, adhesiveness of the surface treatment layer to a liquid repellent material having a Si—OX (X is a methyl or ethyl group) or a hydroxyl (OH) group at the end thereof can be enhanced while the reliability in resistance to ink of the surface treatment layer can be enhanced.

Next, a second example of the second embodiment for use in preventing occurrence of the trade-off problem mentioned above will be described.

In this second example, the content of O in a surface portion of the surface treatment layer 120 (i.e., at the interface between the surface treatment layer and the organic liquid repellent layer 121) is increased.

Figure 9:
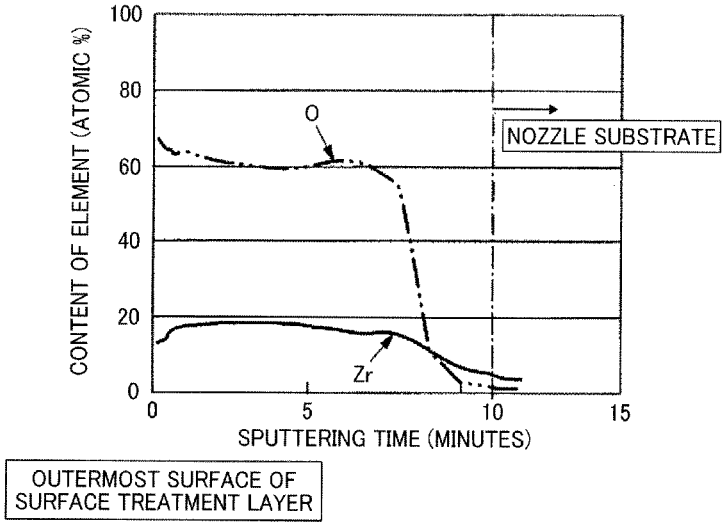

FIG. 9 illustrates the elemental profile of a SiZrOx surface treatment layer in the depth direction (i.e., in the direction of from the outer surface of the surface treatment layer 120 toward the nozzle substrate 110), which is determined by X-ray photoelectron spectroscopy (XPS). In FIG. 9, only an example in which Zr is included in the surface treatment layer is illustrated. However, the element is not limited thereto, and other elements can also be used.

It is clear from FIG. 9 that the content of oxygen in the outermost surface portion of the surface treatment layer 120 is higher than that in the other portions of the surface treatment layer.

Such a layer can be prepared by ALD methods. In the ALD methods, $O_2$ plasma and $H_2O$ are generally used as the gas (reaction gas) for use in reacting the source gas. By controlling the amount of such a reaction gas, the content of oxygen in the outermost surface portion of the surface treatment layer 120 can be increased.

By thus increasing the oxygen content, the outermost surface portion of the surface treatment layer 120 becomes an oxide layer more securely, and the hydrogen bond concentration increases, thereby enhancing the bond strength of the surface treatment layer.

As mentioned above, in this example the ratio of O to a transition metal in the surface treatment layer 120 is higher in the surface portion of the layer than that in the inner portion of the layer. Therefore, the content of OH groups at the interface between the surface treatment layer 120 and the liquid repellent layer 121 can be increased, thereby enhancing the adhesiveness of the surface treatment layer to the organic liquid repellent layer because of increase in the number of hydrogen bonds. In this regard, since the content of the transition metal is higher in the inner portion of the surface treatment layer 120 than that in the surface portion thereof, the reliability in resistance to ink can also be enhanced.

Next, a third embodiment of the liquid ejection head of this disclosure in which the adhesiveness of the surface treatment layer 120 to the nozzle substrate 110 is enhanced will be described.

In a first example of the third embodiment, the content of Si in the surface treatment layer 120 in a bottom portion facing the nozzle substrate 110 (i.e., at an interface between the surface treatment layer and the nozzle substrate) is increased.

Figure 10:
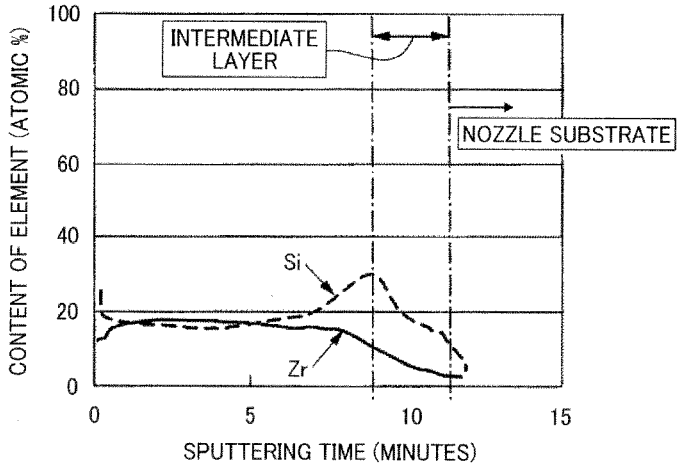
FIGS. 10 and 11 are graphs illustrating the content of elements in another surface treatment layer in a depth direction of from the outermost surface of the surface treatment layer to the lower member (nozzle surface)

FIG. 10 illustrates the elemental profile of a SiZrOx surface treatment layer in the depth direction (i.e., in the direction of from the outer surface of the surface treatment layer 120 toward the nozzle substrate 110), which is determined by X-ray photoelectron spectroscopy (XPS). In FIG. 10, only an example in which Zr is included in the surface treatment layer is illustrated. However, the element is not limited thereto, and other elements can also be used.

By increasing the Si content in the bottom portion of the surface treatment layer 120, the adhesiveness of the surface treatment layer to Si substrates, and substrates including other metals having good compatibility with Si such as Ni electroforming substrates and stainless steel (SUS) substrates can be enhanced.

Thus, in this example, the ratio of Si to a transition metal in the surface treatment layer 120 is higher in the bottom portion of the layer (i.e., at the interface between the surface treatment layer and the nozzle substrate 110) than that in the inner portion of the layer. In this case, Si easily forms an intermediate layer with the nozzle substrate 110, and therefore the surface treatment layer is mixed with the nozzle substrate 110, thereby enhancing the adhesiveness of the surface treatment layer to the substrate (such as Si substrates, and substrates including other metals having good compatibility with Si such as Ni electroforming substrates and stainless steel (SUS) substrates) while enhancing the reliability in resistance to ink.

Next, a second example of the third embodiment will be described. In this second example, the content of O (oxygen) in the bottom portion of the surface treatment layer 120 (i.e., the interface between the surface treatment layer and the nozzle substrate 110) is decreased.

Figure 11:
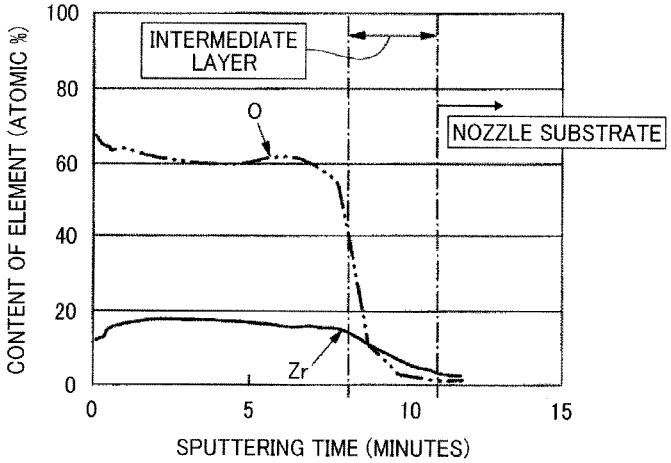

FIG. 11 illustrates the elemental profile of a SiZrOx surface treatment layer in the depth direction (i.e., in the direction of from the outer surface of the surface treatment layer 120 toward the nozzle substrate 110), which is determined by X-ray photoelectron spectroscopy (XPS). In FIG. 11, only an example in which Zr is included in the surface treatment layer is illustrated. However, the element is not limited thereto, and other elements can also be used.

By decreasing the oxygen content in the bottom portion of the surface treatment layer 120, the adhesiveness of the surface treatment layer to Si substrates, and substrates including other metals having good compatibility with Si such as Ni electroforming substrates and stainless steel (SUS) substrates can be enhanced.

Thus, in this example, the ratio of Si to a transition metal in the surface treatment layer 120 is higher in the bottom portion of the layer (i.e., at the interface between the surface treatment layer and the nozzle substrate 110) than that in the inner portion of the layer. In this case, Si easily forms an intermediate layer with the nozzle substrate 110, and therefore the surface treatment layer is mixed with the nozzle substrate 110, thereby enhancing the adhesiveness of the surface treatment layer to the substrate (such as Si substrates, and substrates including other metals having good compatibility with Si such as Ni electroforming substrates and stainless steel (SUS) substrates) while enhancing the reliability in resistance to ink.

As mentioned above, the liquid ejection head of this disclosure has the following configuration:

(1) a surface treatment layer 120 is formed on the surface of a nozzle substrate 110:

(2) the surface treatment layer 120 is an oxide layer including Si, and a transition metal capable of forming a passive layer;

(3) an organic liquid repellent layer 121 is formed on the surface treatment layer 120, wherein the ratio (Si/M) of Si to the transition metal is greater in the surface portion of the surface treatment layer facing the organic repellent layer 121 than that in the inner portion of the surface treatment layer, and the ratio (Si/M) of Si to the transition metal (M) is less in the bottom portion of the surface treatment layer facing the nozzle substrate 110 than that in the inner portion of the surface treatment layer, and wherein the ratio (O/M) of oxygen (O) to the transition metal (M) is greater in the surface portion of the surface treatment layer facing the organic repellent layer 121 than the ratio in the inner portion of the surface treatment layer, and the ratio (O/M) of oxygen (O) to the transition metal (M) is less in the bottom portion of the surface treatment layer facing the nozzle substrate 110 than the ratio in the inner portion of the surface treatment layer.

As a result of measurement of receding contact angle of the liquid ejection head before and after the wiping test performed before and after the ink dipping test, it can be confirmed that the liquid ejection head has a high receding contact angle before and after the ink dipping test.

Next, the thickness of the surface treatment layer 120 will be described.

As the thickness of the surface treatment layer 120 increases, the residual stress of the layer increases, and therefore the size of crystal particles in the layer increases, thereby increasing the number of defects in the layer, resulting in increase in solubility of the layer in ink. In this case, when the surface treatment layer 120 is dipped into ink, the layer is deteriorated, thereby deteriorating the adhesiveness of the layer to the liquid repellent layer 121, resulting in deterioration of the liquid repellency of the layer, i.e., deterioration of the ejection reliability of the liquid ejection head.

Therefore, the surface treatment layer 120 preferably has a thickness of not greater than 200 nm.

Figure 12:
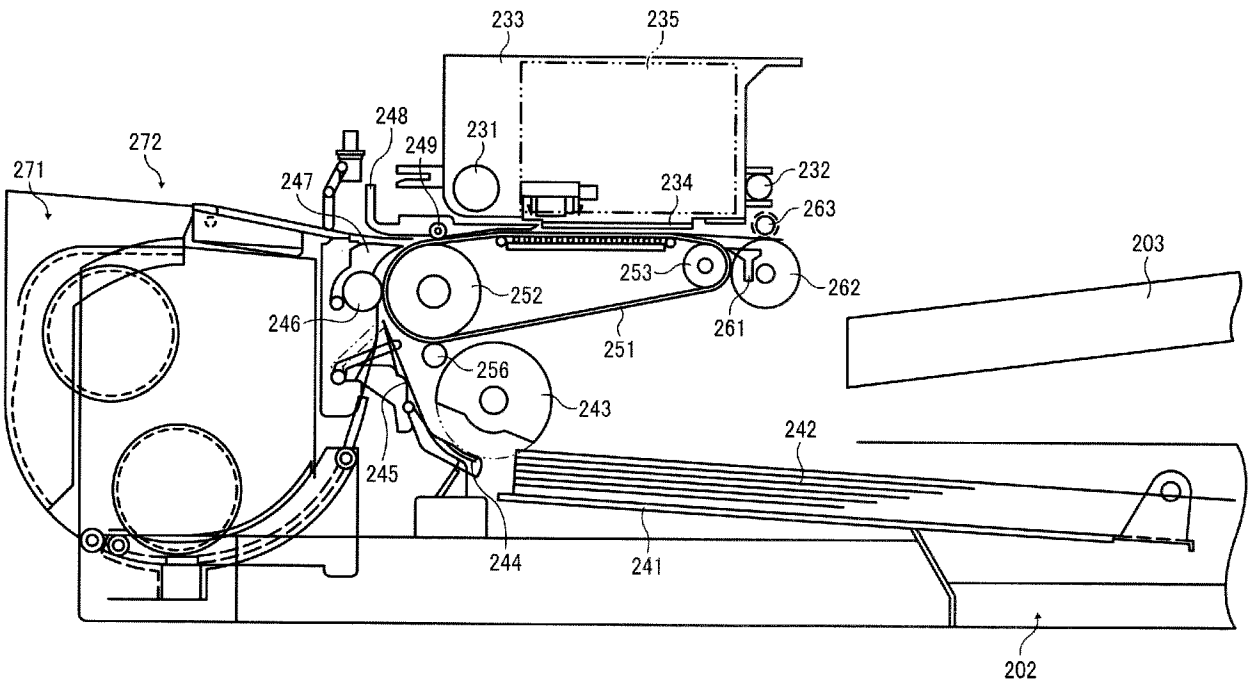
FIG. 12 is a schematic side view illustrating an example of the image forming apparatus according to an embodiment.

An example of the image forming apparatus of this disclosure will be described by reference to FIGS. 12 and 13. FIG. 12 is a side view of the mechanical section of the image forming apparatus, and FIG. 13 is a plane view of the main portion of the mechanical section.

This image forming apparatus is a serial image forming apparatus.

Figure 13:
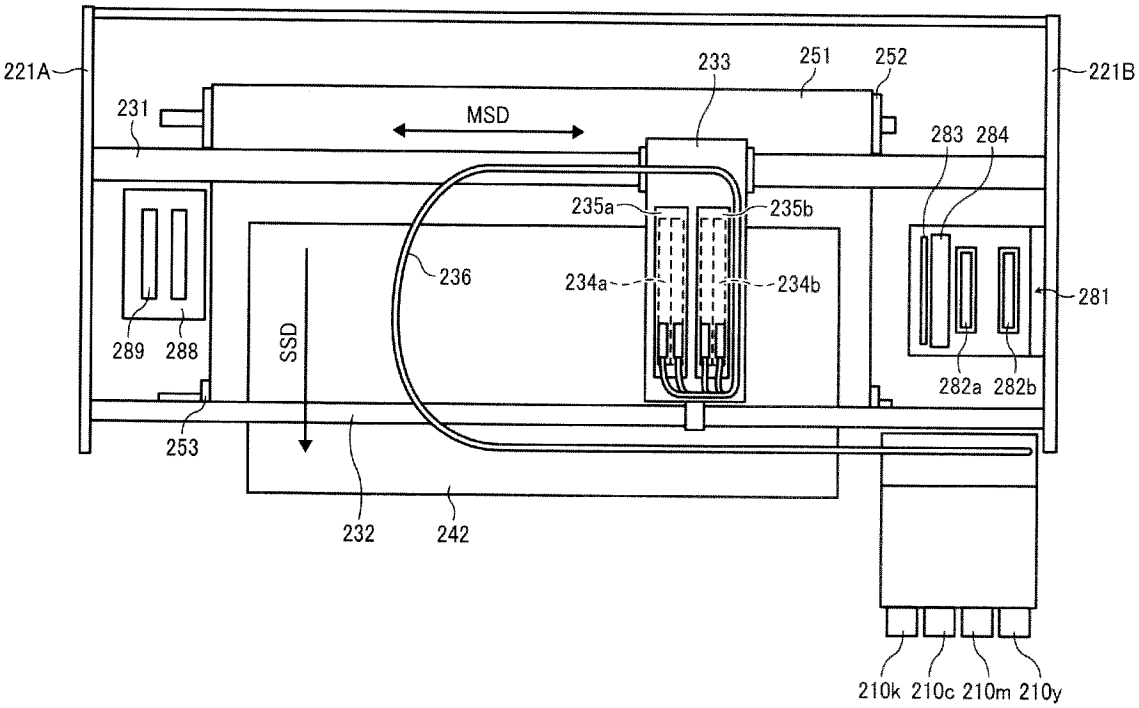
FIG. 13 is a schematic plan view of the main portion of the image forming apparatus illustrated in FIG. 12.

Referring to FIGS. 12 and 13, the image forming apparatus includes guide rods 231 and 232, which are supported by both of side walls 221A and 221B of the image forming apparatus and which serve as guide members to guide a carriage 233 so as to freely slide (i.e., scan) in a main scanning direction MSD. Scanning of the carriage 233 is performed by a main scanning motor (not shown) via a timing belt.

A recording head 234, which is a liquid ejection head of this disclosure and which ejects yellow (Y), cyan (C), magenta (M) and black (K) ink droplets, is provided on the carriage 233. In the recording head 234, a line of nozzles is arranged in a sub-scanning direction SSD perpendicular to the main scanning direction MSD so that ink droplets are ejected downward from the nozzles.

The recording head 234 includes two heads 234*a* and 234*b*. The heads 234*a* includes two lines of nozzles, wherein droplets of the black ink are ejected from one of the two lines of nozzles, and droplets of the cyan ink are ejected from the other of the two lines of nozzles. The heads 234*b* also includes two lines of nozzles, wherein droplets of the magenta ink are ejected from one of the two lines of nozzles, and droplets of the yellow ink are ejected from the other of the two lines of nozzles. In this regard, the number of the heads of the recording head 234 is not limited to two, and one head having four lines of nozzles can also be used. The recording head 234 has head tanks 235 (235*a* and 235*b*) thereon, and Y, M, C and K inks are supplied to the head tanks 235 (235*a* and 235*b*) from ink cartridges 210 (210*y*, 210*m*, 210*c* and 210*k*) by an ink supply unit through a supply tube 236.

The image forming apparatus further includes a sheet feeding section to feed a recording sheet 242 set on a sheet loading portion (pressure plate) 241 of a sheet tray 202. The sheet feeding section includes a half-moon-shaped feed roller 243 to feed the recording sheet 242 one by one from the sheet loading portion 241, and a separation pad 244 which faces the feed roller 243 and which has a high friction coefficient. The separation pad 244 is pressed toward the feed roller 243.

In order to feed the recording sheet 242, which has been fed from the sheet feeding section, to the recording head 234, the image forming apparatus further includes a guide 245 to guide the recording sheet 242, a counter roller 246, a feed guide member 247, and a pressing member 248 having a pressure roller 249. In addition, the image forming apparatus further includes a feeding belt 251 to electrostatically attract the thus fed recording sheet 242 while feeding the recording sheet to a position at which the recording sheet faces the recording head 234.

The feeding belt 251 is an endless belt which is looped over a feed roller 252 and a tension roller 253 so as to circulate in a belt moving direction (i.e., the sub-scanning direction SSD). Further, the image forming apparatus includes a charging roller 256 serving as a charger to charge the surface of the feeding belt 251. The charging roller 256 is contacted with the surface of the feeding belt 251 and is rotated while driven by the feeding belt. The feeding belt 251 is circulated in the sub-scanning direction by the feed roller 252 which is rotated by a sub-scanning motor (not shown).

The image forming apparatus further includes a sheet discharging section to discharge the recording sheet 242 on which an ink image is formed by the recording head 234. The sheet discharging section includes a separation pick 261 to separate the recording sheet 242 from the feeding belt 251, and discharging rollers 262 and 263. In addition, the sheet discharging section includes a copy receiving tray 203 which is located below the discharging roller 262.

The image forming apparatus further includes a duplex printing unit 271 which is detachably attached to the backside of the main body of the image forming apparatus. The duplex printing unit 271 receives the recording sheet 242, which is returned by the feeding belt 251 rotated in the opposite direction, and reverses the recording sheet to feed the recording sheet to the nip between the counter roller 246 and the feeding belt 251. The upper surface of the duplex printing unit 271 serves as a manual recording sheet tray 272.

Further, the image forming apparatus includes a maintenance/recovery mechanism 281 to perform maintenance and recovery operations on the recording head 234 at one end portion thereof in the main scanning direction MSD (i.e., in one of non-printing areas in the main scanning direction). The maintenance/recovery mechanism 281 includes caps 282 (282*a* and 282*h*) to cap the nozzle surfaces of the recording head 234, a wiper blade 283 to wipe the nozzle surface of the recording head, and a dummy discharge ink receiver 284 which receives viscous inks (i.e., dummy discharge inks not used for image formation) ejected from the recording head.

In addition, the image forming apparatus includes another dummy discharge ink receiver 288 at the other end portion thereof (i.e., the other non-printing area) in the main scanning direction MSD. The dummy discharge ink receiver 288 receives viscous inks (i.e., dummy discharge inks not used for image formation) ejected from the recording head 234 in an image forming operation. The dummy discharge ink receiver 288 has an opening 289 extending so as to face the nozzles of the recording head 234.

In this image forming apparatus, the recording sheets 242 are fed upward from the sheet tray 202 one by one. After the recording sheet 242 thus fed upward is guided by the guide 245, the recording sheet is sandwiched by the feeding belt 251 and the counter roller 246 so as to be fed. Further, the tip of the recording sheet 242 is guided by the feed guide member 247 and then fed by the feeding belt 251 while pressed by the pressure roller 249 toward the feeding belt. In this regard, the feeding direction of the recording sheet 242 is changed by about 90 degree by the feed guide member 247, the pressing member 248, and the pressure roller 249.

At this time, an alternate voltage is applied to the charging roller 256, and therefore the feeding belt 251 is charged in such a manner that a positively-charged portion and a negatively-charged portion are alternately formed on the surface of the feeding belt 251 in the sub-scanning direction SSD. When the recording sheet 242 is fed to the thus charged feeding belt 251, the recording sheet is electrostatically attracted by the feeding belt, and therefore the recording sheet is fed in the sub-scanning direction by the feeding belt.

When the recoding sheet 242 is fed to the printing area, the carriage 233 is moved in the main scanning direction MSD and the recording head 234 on the carriage ejects ink droplets according to image signals to form one line ink image on the stopped recording sheet. After the recording sheet 242 is fed by a certain length, another line ink image is formed by the recording head 234. When the image forming apparatus receives a record end signal or detects that the rear end of the recording sheet 242 reaches the printing area, the image forming apparatus stops the recording operation and discharges the recording sheet to the copy receiving tray 203.

As mentioned above, this image forming apparatus uses the liquid ejection head of this disclosure for the recording head, high quality images can be stably produced.

In this image forming apparatus, the carriage 233 serves as a support of the recording head 234 (i.e., the liquid ejection head).

In this application, specific examples of the material of the recording sheet 242 include paper, OHP films (films for overhead projectors), cloths, glass and boards, to which an ink droplet or a droplet of other liquids can be adhered. Namely, so-called recording media, recording paper, printing paper and the like can be used as the recording sheet 242.

In addition, the terms such as image formation, recording and printing have the same meaning in this application.

In this application, the image forming apparatus means an image forming apparatus which ejects a liquid toward a recording medium such as paper, strings, fibers, cloths, leathers, plastics, glass, woods, and ceramics to form an image on the recording medium.

In addition, image formation can include formation of a meaningless image such as patterns and adhesion of one or more droplets of a liquid as well as formation of meaningful images such as character images and figures.

Further, in this application, ink means not only so-called inks (such as inkjet inks) but also other liquids for use in image formation, such as recording liquids and fixing liquids. For example, liquids such as DNA samples, resist materials, pattern materials, and resins can also be used.

In this application, image means not only two-dimensional images, but also other images such as images formed on a three-dimensional material, and three-dimensional images.

Further, the image forming apparatus of this disclosure is not limited to serial image forming apparatuses, and can be used for line image forming apparatuses.

As mentioned above, in the liquid ejection head of this disclosure, the interface between the organic liquid repellent layer and the lower member (the nozzle substrate) has good resistance to ink.

Additional modifications and variations of the present invention are possible in light of the above teachings. It is therefore to be understood that within the scope of the appended claims the invention may be practiced other than as specifically described herein.

What is claimed is:

1. A liquid ejection head comprising:

a nozzle substrate to eject a droplet of a liquid from a nozzle thereof;

a surface treatment layer, which is located on a surface of the nozzle substrate and which is an oxide layer including silicon (Si) and a transition metal (M) capable of forming a passive layer; and an organic liquid repellent layer located on the surface treatment layer.

2. The liquid ejection head according to claim 1, wherein a ratio (Si/M) of silicon (Si) to the transition metal (M) is higher in a surface portion of the surface treatment layer facing the organic liquid repellent layer than the ratio (Si/M) in an inner portion of the surface treatment layer.

3. The liquid ejection head according to claim 1, wherein a ratio (O/M) of oxygen (O) to the transition metal (M) is higher in a surface portion of the surface treatment layer facing the organic liquid repellent layer than the ratio (O/M) in an inner portion of the surface treatment layer.

4. The liquid ejection head according to claim 1, wherein a ratio (Si/M) of silicon (Si) to the transition metal (M) is higher in a bottom portion of the surface treatment layer facing the nozzle substrate than the ratio (Si/M) in an inner portion of the surface treatment layer.

5. The liquid ejection head according to claim 1, wherein a ratio (O/M) of oxygen (O) to the transition metal (M) is lower in a bottom portion of the surface treatment layer facing the nozzle substrate than the ratio (O/M) in an inner portion of the surface treatment layer.

6. The liquid ejection head according to claim 1, wherein the transition metal includes at least one of Group-4 and Group-5 transition metals.

7. The liquid ejection head according to claim 6, wherein the transition metal includes at least one of Hf, Ta and Zr.

8. The liquid ejection head according to claim 1, wherein the surface treatment layer includes silicon (Si) in an amount of not less than 17 atomic percent.

9. The liquid ejection head according to claim 1, wherein the surface treatment layer includes the transition metal in an amount of not less than 2 atomic percent.

10. An image forming apparatus comprising:

the liquid ejection head according to claim 1 to eject a droplet of a liquid from a nozzle thereof to form an image on an object; and a support to support the liquid ejection head.

* * * * *